US006067901A

United States Patent [19]

Takahashi

[11] Patent Number: 6,067,901

[45] **Date of Patent: *May 30, 2000**

[54] WASTE MASTER COLLECTING DEVICE FOR A STENCIL PRINTER

[75] Inventor: Takayuki Takahashi, Shibata-machi, Japan

[73] Assignee: Tohoku Ricoh Co., Ltd., Miyahi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/926,013

[22] Filed: Sep. 9, 1997

[30] Foreign Application Priority Data

Dec. 13, 1996 [JP] Japan ..... 8-333921
Jul. 23, 1997 [JP] Japan ..... 9-196842

[51] Int. Cl.[7] ..... B41L 13/06

[52] U.S. Cl. ..... 101/114; 101/116; 101/477

[58] Field of Search ..... 101/114, 116–120, 101/477, 479, 483

[56] References Cited

U.S. PATENT DOCUMENTS 5,323,706 6/1994 Sugawara ..... 101/477
5,535,671 7/1996 Kanno ..... 101/116
5,713,274 2/1998 Kawai et al. ..... 101/114

FOREIGN PATENT DOCUMENTS 59-11281 1/1984 Japan .
61-185471 8/1986 Japan .
61-204765 12/1986 Japan .
6-199029 7/1994 Japan .
6-247032 9/1994 Japan .
8-33592 2/1996 Japan .
8-142484 6/1996 Japan .
8-142485 6/1996 Japan .
8-142486 6/1996 Japan .
8-158415 6/1996 Japan .
9-11601 1/1997 Japan .

*Primary Examiner*—Ren Yan
*Attorney, Agent, or Firm*—Oblon, Spivak, McClelland, Maier & Neustadt, P.C.

[57] ABSTRACT

A device for collecting waste or used masters and applicable to a stencil printer or similar printer is disclosed. The device includes a waste master box accommodating a compression plate therein. The compression plate is rotatable at least more than 90 degrees about a shaft on which it is mounted. Every time a waste master peeled off a print drum is introduced into the box, the compression plate rotates over the above angular range in order to compress the waste master. The box prevents consecutive waste masters sequentially compressed by the compression plate from being localized.

27 Claims, 19 Drawing Sheets

WASTE MASTER COLLECTING DEVICE FOR A STENCIL PRINTER

BACKGROUND OF THE INVENTION

The present invention relates to a device for automatically collecting waste masters used in a stencil printer or similar printer.

It is a common practice with a stencil printer to wrap a master around a print drum, feed ink to the inner periphery of the print drum, and transfer the ink to a paper via the perforations of the master so as to print an image on the paper. After the printing operation, the waste or used master is peeled off the print drum, driven out onto a tray, and then discarded by the operator. This kind of master discharging scheme, however, often causes the ink deposited on the waste master to smear the operator's hands and cloths. To solve this problem, there has been proposed and extensively used a waste master collecting device including a box for automatically collecting the waste master peeled off the print drum and conveyed to the box.

However, if the consecutive waste masters are simply dropped into and stacked on the above box by gravity, they become bulky and cannot be efficiently stored in the box. In light of this, a raising and lowering mechanism using a pantagraph-like arm or an eccentric cam or a pivoting mechanism using an arm and a rotary shaft may be driven by drive means, e.g., gearing or a disk and motor device. The raising and lowering mechanism and pivoting mechaism each causes a compression plate to compress a waste master peeled off the print drum and introduced into the box. These schemes are disclosed in, e.g., Japanese Utility Model Laid-Open Publication No. 61-204765 and Japanese Patent Laid-Open Publication Nos. 59-11281 and 8-142484 as well as in Japanese Patent Application No. 7-161697.

However, the conventional schemes using the compression plate have a problem that the waste master introduced into the box hangs down due to its own weight and cannot reach the deepest portion of the box. As a result, the consecutive waste masters are locally stacked only in the upstream portion of the box with respect to the direction of master transport, obstructing a waste master being introduced into the box.

Technologies relating to the present invention are also taught in Japanese Patent Application Nos. 8-33592 and 8-158415.

SUMMARY OF THE INVENTION

It is therefore an object of the present invention to provide a waste master collecting device for a stencil printer capable of solving the above problem that consecutive waste masters introduced into a waste master box hang down due to their own weight and gather only in the upstream portion of the box, obstructing a waste master being introduced into the box.

A waste master collecting device for a printer of the present invention includes a waste master discharging member for peeling off a waste master wrapped around a print drum of the printer, and conveying the waste master. A waste master box accommodates the waste master conveyed by the waste master discharging member. The waste master box has a compression plate for compressing the waste master introduced into the box by the waste master discharging member, and a shaft supporting one edge of the compression plate such that the plate extends substantially perpendicularly to a waste master discharge path, and causing the compression plate to rotate about the shaft in the box. The compression plate is rotatable at least more than 90 degrees about the shaft for compressing the waste master introduced into the box.

BRIEF DESCRIPTION OF THE DRAWINGS

The above and other objects, features and advantages of the present invention will become apparent from the following detailed description taken with the accompanying drawings in which.

In the figures, identical references denote identical structural elements.

DESCRIPTION OF THE PREFERRED EMBODIMENTS

Figure 1:
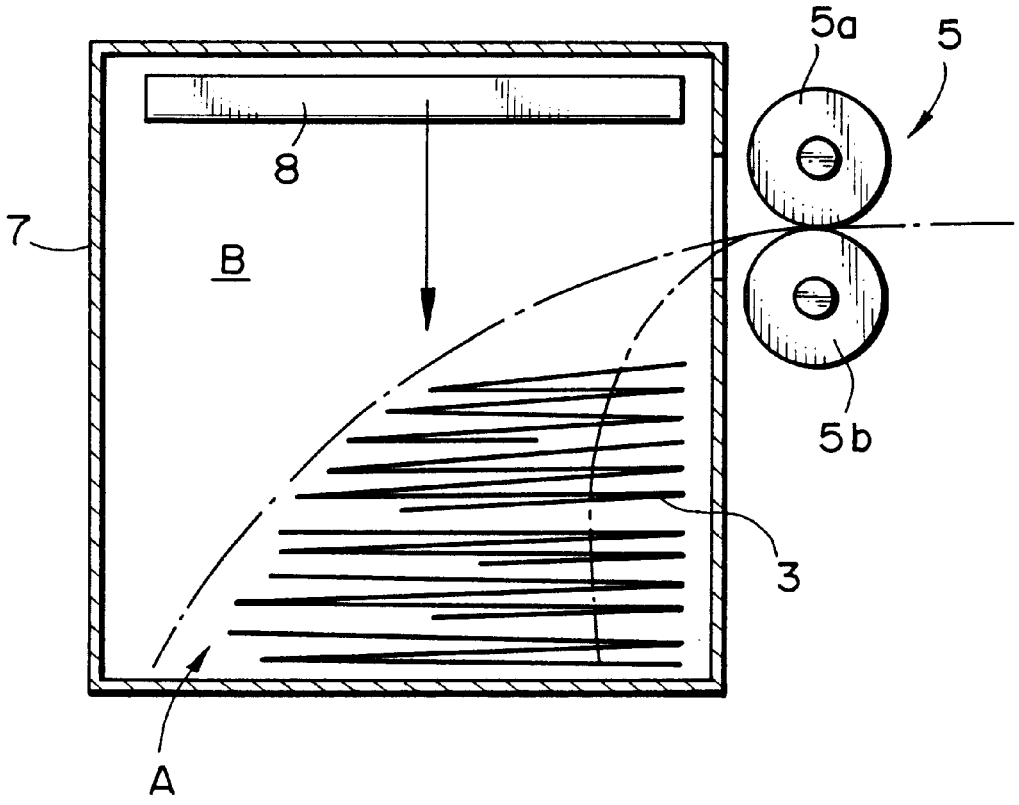
FIG. 1 PRIOR ART
FIG. 1 is a sectional front view showing a conventional waste master collecting device including a compression plate movable up and down.
Figure 2:
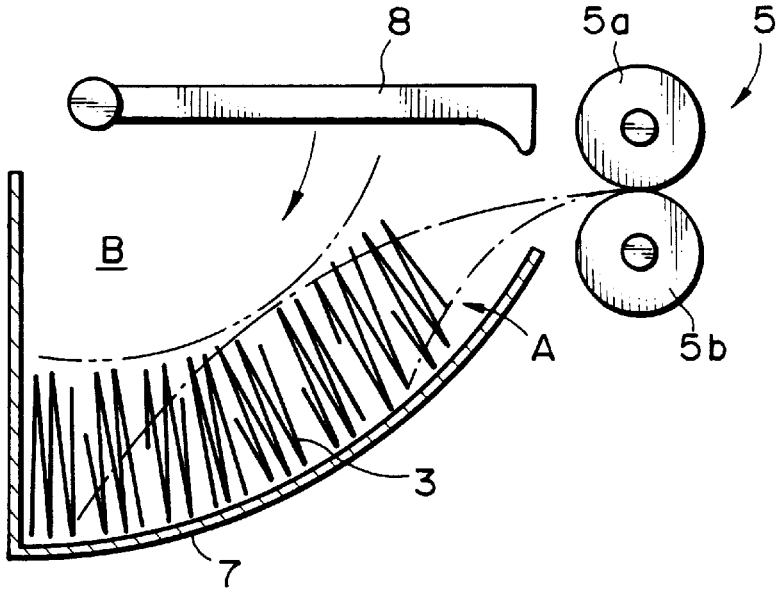
FIG. 2 PRIOR ART
FIG. 2 is a sectional front view showing another conventional waste master collecting device including a pivotable compression plate.

To better understand the present invention, brief reference will be made to conventional waste master collecting devices capable of collecting used masters efficiently. FIG. 1 shows a conventional master collecting device including a waste master box 7 and a compression plate 8 disposed in the box 7. The compression plate 8 is movable up and down within the waste master box 7. FIG. 2 shows another conventional waste master collecting device in which the compression plate 8 is pivotable about a shaft within the waste master box 7. The compression plates 8 shown in FIGS. 1 and 2 each compresses a waste or used master 3 peeled off and conveyed by a discharge roller pair 5 into the box 7. The discharge roller pair 5 is made up of a peeler roller 5*a* and a conveyor roller 5*b*.

The conventional devices shown in FIGS. 1 and 2 have the following problems left unsolved. The waste master 3 introduced into the box 7 by the discharge roller pair 5 tends to hang down due to its own weight and accumulates in the upstream portion of the box 7 in the direction of master transport, as indicated by dash-and-dot lines in FIGS. 1 and 2. This prevents the master 3 from reaching the deepest portion of the box 7. Further, the master 3, if compressed in the deepest portion of the box 7, falls down to the upstream side in the direction of master transport due to its own weight, as indicated by a dash-and-dot line in FIG. 3. These are presumably ascriable to an increase in the weight of the master 3 due to ink deposited thereon, a decrease in the elasticity of the master 3, the adhesion of the master 3 to a print drum, not shown, counteracting the conveying force of the roller pair 5, and the configuration of the box 7.

Figure 3:
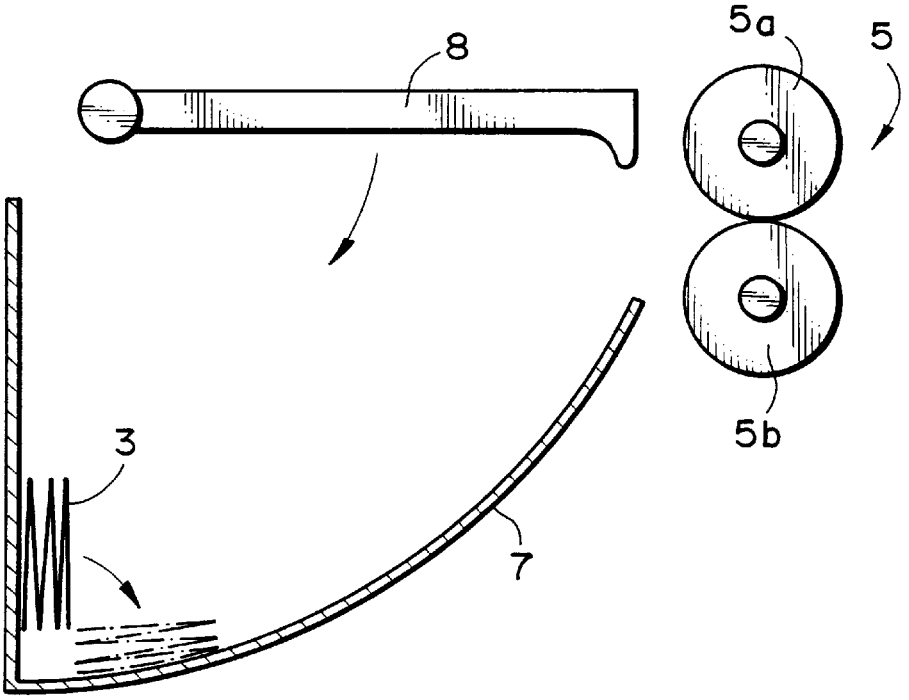
FIG. 3 PRIOR ART
FIG. 3 demonstrates the operation of the device shown in FIG. 2.

In the above condition, as shown in FIGS. 1 and 2, the master 3 introduced into the box 7 by the roller pair 5 is compressed only in a part A of the space available in the box 7. As a result, despite that the other part B of the space of the box 7 is unoccupied, the compression plate 8 reaches its limit point as to up-and-down movement (FIG. 1) or pivotal movement (FIG. 2), causing a sensor to produce an output indicative of the full state of the box 7. Consequently, the space B is simply wasted, i.e., turns out a dead space. Morever, when the compressed master 3 falls down in the deepest portion of the box 7, as shown in FIG. 3, it obstructs the next waste master 3 to be introduced into the box 7.

Figure 4:
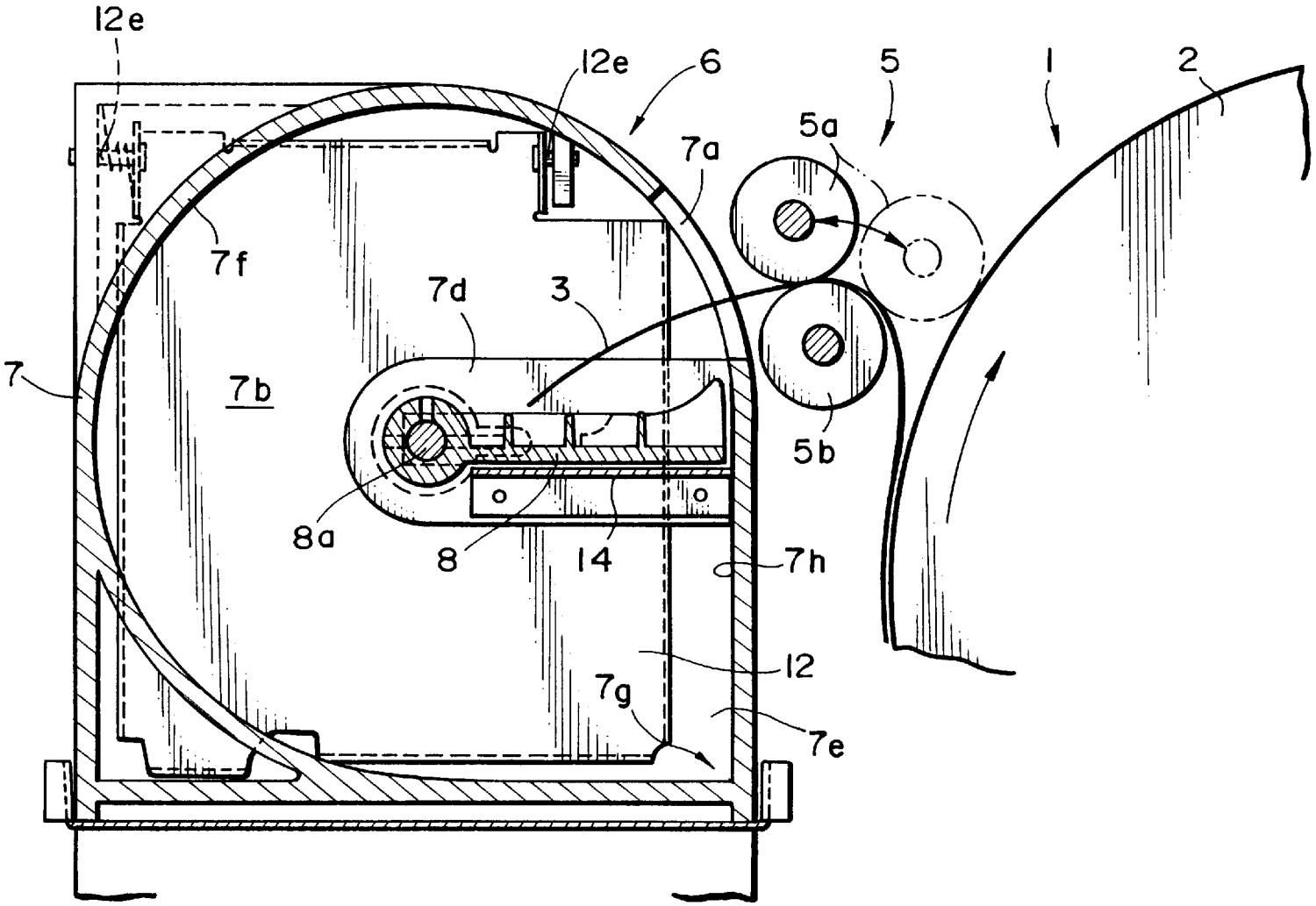
FIG. 4 is a sectional front view showing a waste master collecting device embodying the present invention.

Referring to FIG. 4, a waste master collecting device embodying the present invention is shown together with a part of a stencil printer on which it is mounted. As shown, the stencil printer, generally 1, includes a print drum 2 and a discharge roller pair 5 made up of a peeler roller 5*a* and a conveyor roller 5*b*. After the printer 1 has ended its printing operaton, the peeler roller 5*a* is moved from a conveying position indicated by a solid line to a peeling position indicated by a dash-and-dots line and rotated clockwise, as viewed in FIG. 4. At the same time, the drum 2 is also rotated clockwise. As a result, the peeler roller 5*a* peels off a waste master 3 from the drum 2. Then, the peeler roller 5*a* is returned to the conveying position and cooperates with the conveyor roller 5*b* to nip and convey the master 3. The waste master collecting device, generally 6, is located on a master transport path downstream of the roller pair 5 and includes a waste master box 7 formed with a master inlet 7*a*. The master 3 introduced into the waste master box 7 via the inlet 7*a* is brought to a position above a compression plate 8 disposed in the box 7. If desired, the roller pair 5 playing the role of master discharging means may be replace with, e.g., endless belts, bladed wheels or wheel-like rollers.

Figure 5:
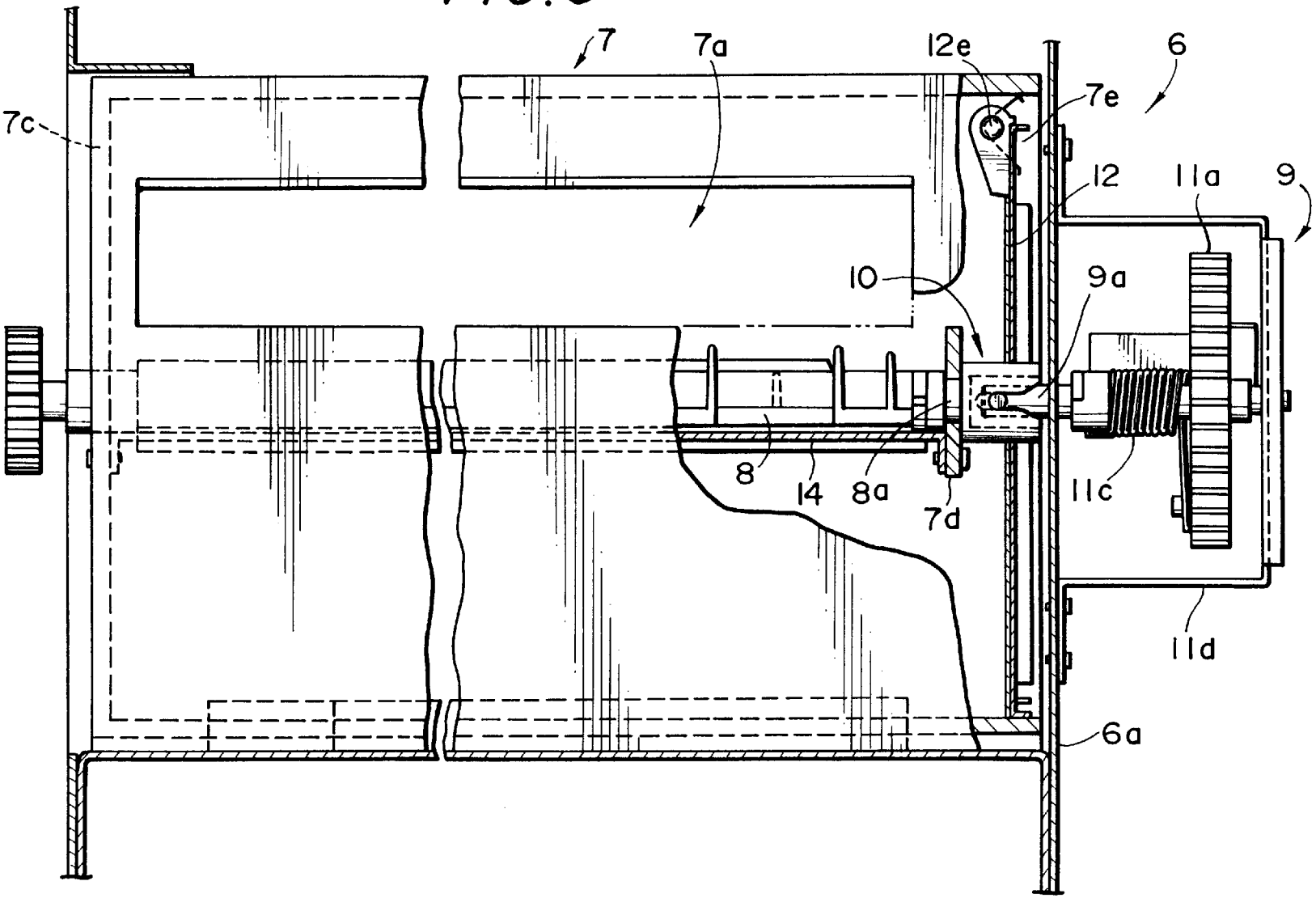
FIG. 5 is a partly taken away sectional side elevation of the embodiment as seen from a master inlet side.
Figure 6:
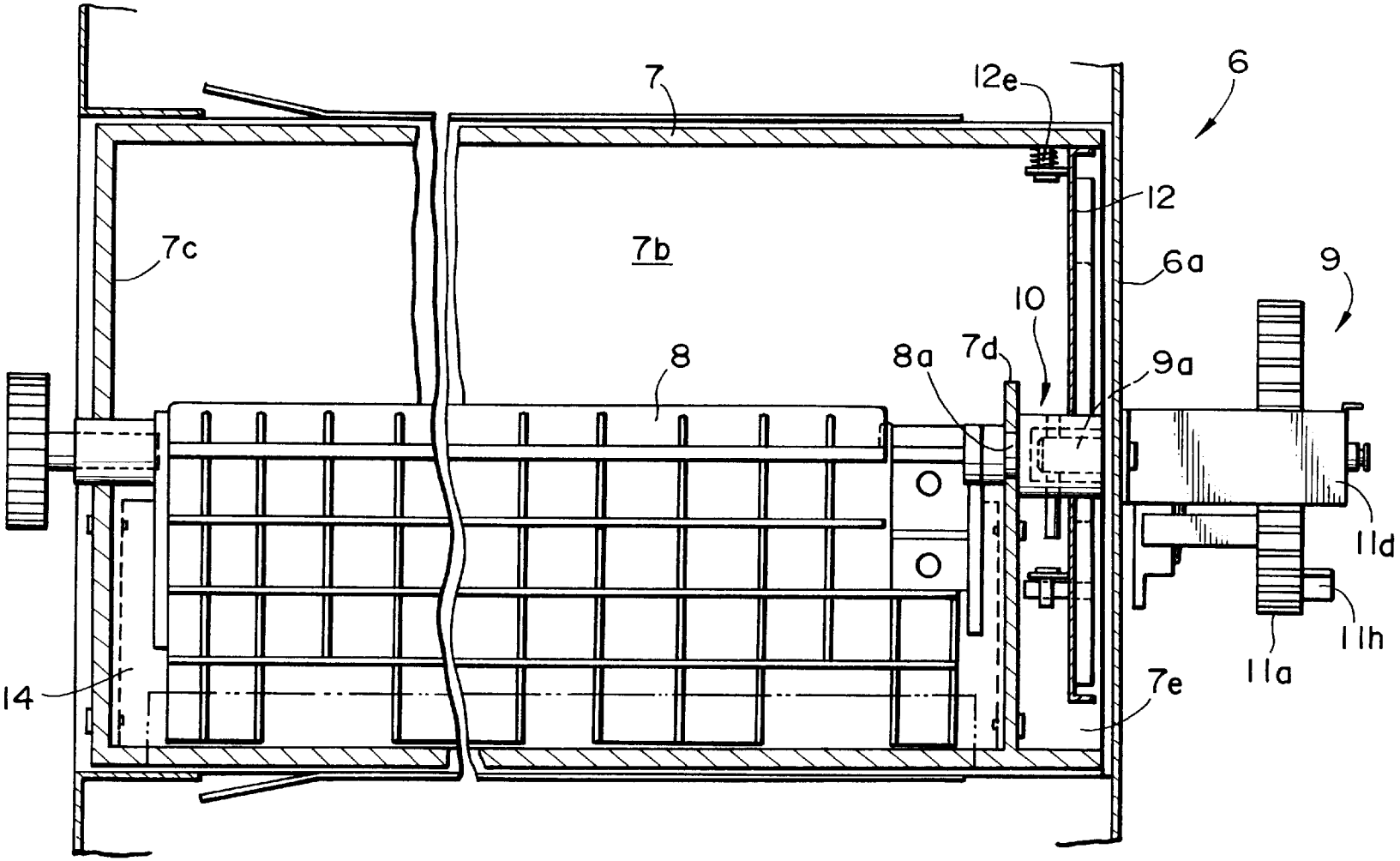
FIG. 6 is a partly taken away sectional plan view of the embodiment.

As shown in FIGS. 4–6, the waste master box 7 has a generally cylindrical configuration and has the master inlet 7*a* in its upper portion. The box 7 has an inner circumferential wall 7*f* partly complementary to the locus of the free edge of the compression plate 8, which will be described, rotatable about 270 degrees. The other part of the circumferential wall 7*f* exceeding the above range is provided with a box-like configuration for accommodating the waste master 3.

As also shown in FIGS. 4–6, the compression plate 8 for compressing the waste master 3 within the box 7 is rotatable about the center of a master storing space 7*b* formed in the box 7. Specifically, a shaft 8*a* provided on one edge of the plate 8 is rotatably supported by substantially the center of a front side wall (left wall as viewed in FIG. 6) 7*c* included in the box 7 and a bracket 7*d* formed integrally with a rear side wall (right wall as viewed in FIG. 6). The shaft 8*a* is substantially parallel to the axes of the rollers 5*a* and 5*b*. The plate 7 is rotatable about 270 degrees about the shaft 8*a* from a home position indicated by dash-and-dots lines in FIGS. 7A–7C. A partition 14 is fixed in place between the front end wall 7*c* and the bracket 7*d* in order to prevent the waste masters 3 collected in the box 7 from overlowing via the inlet 7*a* and to prevent the compression plate 8 from rotating excessively toward the home position (clockwidre as viewed in FIG. 4).

Figure 7A:
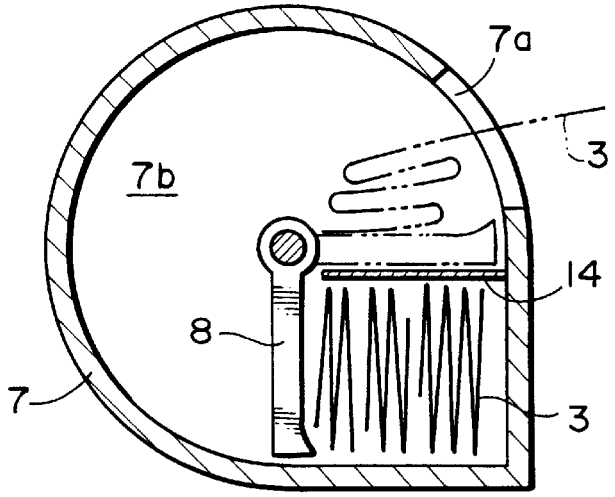
FIGS. 7A–7C are sections demonstrating the operation of the embodiment.
Figure 7B:
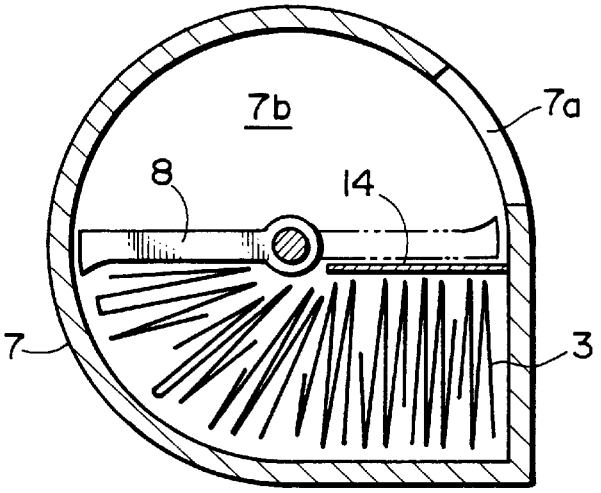
Figure 7C:
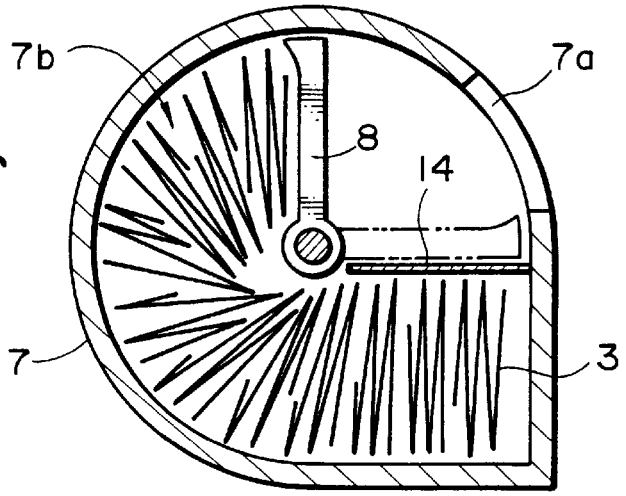

As shown in FIGS. 5 and 6, drive means 9 is arranged outside of a rear side panel included in the collecting device 6, and has a drive shaft 9*a*. The rotation of the drive shaft 9*a* is transmitted to the shaft 8*a* of the compression plate 8, causing the shaft 8*a* to rotate about 270 degrees from its home position shown in FIGS. 7A–7C. Assume that the waste master 3 is conveyed to above the plate 8 via the inlet 7*a* of the box 7. Then, as shown in FIG. 7A, the master 3 is sequentially laid on the plate 8 while being folded due to the viscosity of ink. When the entire master 3 is introduced into the box 7, the plate 8 starts rotating counterclockwise, raising the master 3. The plate 8 rotates about 270 degrees, as shown in FIG. 7A. As a result, the master 3 is compressed in a box-like portion 7*g* outside of the rotatable range of the plate 8. After rotating 270 degrees, the plate 8 returns to its home position in the reverse direction. In this manner, every time a waste master 3 is introduced into the box 7, the plate 8 rotates from the home position to the position about 270 degrees away from the home position. This is repeated until the plate 8 compresses initial several waste masters 3 in the box-like portion 7*g*. As a result, the consecutive masters 3 are sequentially compressed against the right side wall 7*h*, as viewed in FIG. 4, of the portion 7*g* and efficiently stored in the portion 7*g*. Thereafter, as the number of masters 3 collected in the box 7 increases, the rotation angle of the plate 8 sequentially decreases, as shown in FIGS. 7B and 7C.

As stated above, the compression plate 8 rotates about 270 degrees every time a waste master 3 is introduced into the box 7, thereby packing the master storing space 7*b* with such masters 3. Because the plate 8 rotates about the center of the box 7, it obviates a dead space in the box 7 ascribable to the localization of the masters 3 in the box 7. Consequently, the masters 3 are successfully packed in the box 7 without wasting any part of the master storing space 7*b*.

Because the box 7 includes the box-like portion 7*g*, it achieves a greater capacity than a box whose inner circumferential wall 7*b* is entirely cylindrical. The rotation angle of 270 degrees shown and described is only illustrative and may be, e.g., about 300 degrees which brings the plate 8 closer to the partition 14. Even with such a rotation angle, the plate 8 is capable of compressing the waste masters 3 against the wall 7*a* of the box 7.

When the box 7 is filled up with the waste masters 3, a sensor, not shown, turns on and alerts the operator to the full state of the box 7. In response, the operator pulls out the box 7 from the front end of the body of the collecting device 6, discards the masters 3, and then returns the box 7 into the collecting device 6. This prepares the collecting device 6 for the next master collecting operation.

Figure 8:
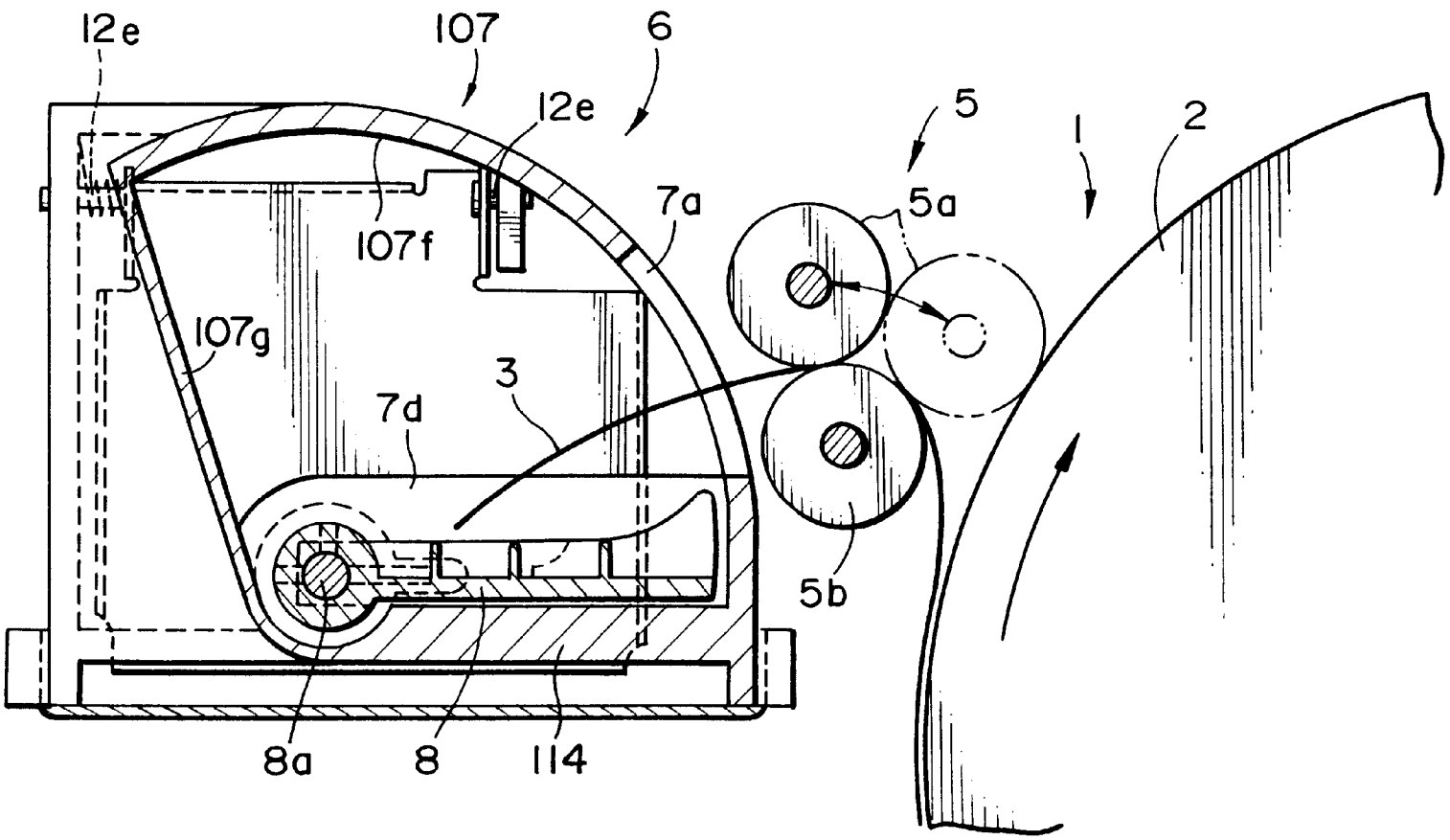
FIGS. 8 and 9 are sectional front views each showing another specific configuration of a waste master box included in the embodiment.
Figure 9:
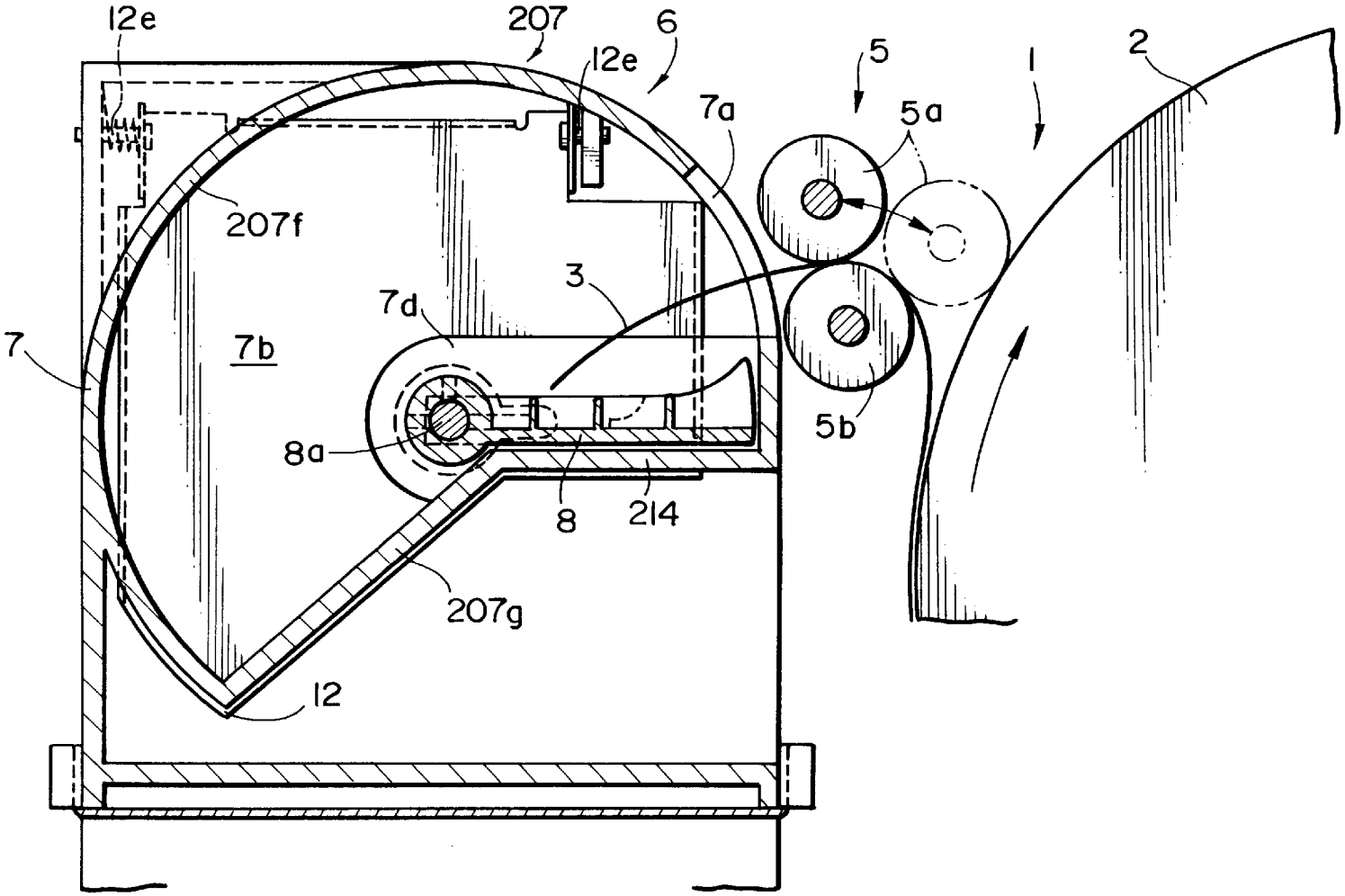

In the illustrative embodiment, the shaft 8*a* of the plate 8 is located at the center of the box 7. FIGS. 8 and 9 each shows another specific configuration of the box. In FIGS. 8 and 9, the plate 8 is rotatable at least more than 90 degrees about the shaft 8*a*.

Specifically, FIG. 8 shows a waste master box 107 having an inner circumferential wall 107*f* complementary to the locus of rotation of the compression plate 8 rotatable about 90 degrees away from its home position. A rear wall 107*g* extends from the end of the circumferential wall 107*f* to the vicinity of the shaft 8*a* of the plate 8. A bottom wall or partition 114 is positioned below the home position of the plate 8. Initially, the plate 8 repeatedly rotates about 90 degrees from its home position, sequentially compressing the masters 3 in the box 107.

Figure 10:
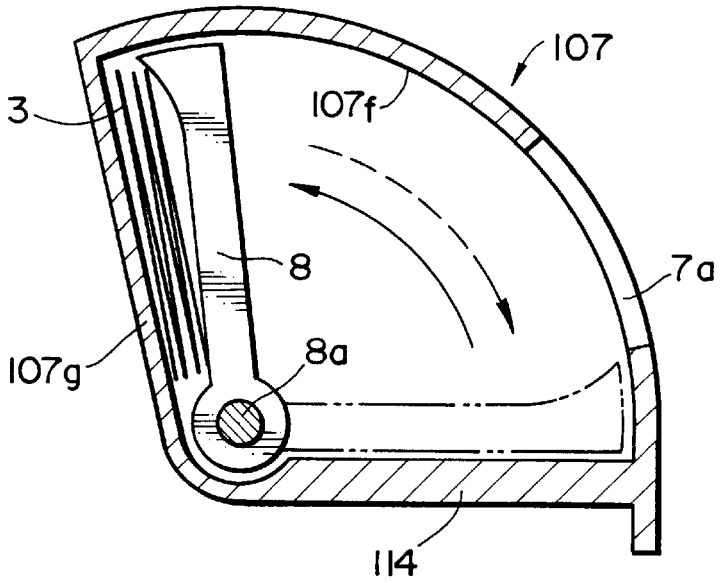
FIGS. 10 and 11 respectively demonstrate the operations of the boxes shown in FIGS. 8 and 9.

As shown in FIG. 10, the master 3 is compressed against the rear wall 107*g* of the box 107 in a folded position. Because the rear wall 107*g* is located at a position which the plate 8 reaches after at least more than 90 degrees of rotation, one or two initially compressed masters 3 which are most unstable in position are prevented from easily slipping down toward the inlet 7*a*. In addition, because the partition is formed integrally with the box 107, an independent partition which would increase the cost is not necessary.

FIG. 9 shows a waste master box 207 more preferable than the box 107 shown in FIG. 8. As shown, the box 207 has an inner circumferential surface 207*f* complentary to the locus of rotation of the compression plate 8 rotatable about 210 degrees away from its home position. A rear wall 207*g* extends from the end of the circumferential wall 207*f* to the vicinity of the shaft 8*a* of the plate 8. A bottom plate or partition 214 is positioned below the home position of the plate 8. Initially, the plate 8 repeatedly rotates about 210 degrees from its home position, sequentially compressing the masters 3 in the box 207.

Figure 11:
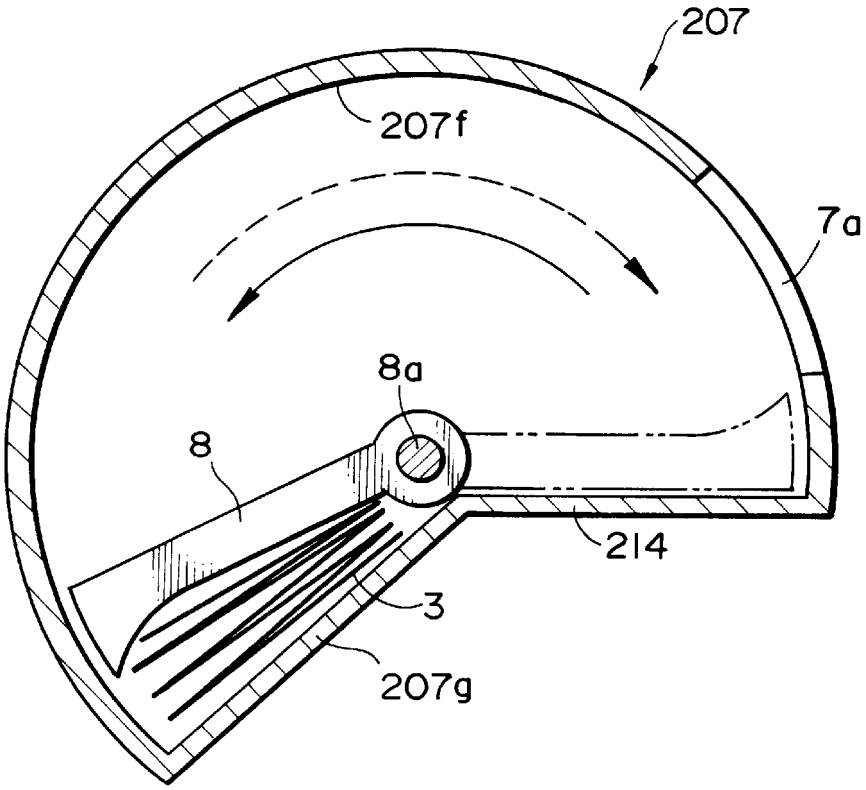

As shown in FIG. 11, even the master 3 introduced into the box 207 first is laid on the rear wall 207*g* in a folded position due to its own weight and is surely prevented from returning to the inlet 7*a*. Again, because the partition is formed integrally with the box 207, an independent partition which would increase the cost is not necessary.

The shaft 8*a* of the plate 8 and the drive shaft 9*a* of the drive means 9 may be directly connected to each other. However, because the plate 8 is disposed in the box 7, the plate 8 should preferably be mounted and dismounted from the body of the printer together with the box 7. Then, the operator can mount and dismount the box 7 and discard the used masters compressed in the box 7 easily. For this purpose, in the illustrative embodiment, the rotation of the drive shaft 9*a* is transmitted to the shaft 8*a* via a coupling 10.

Figure 12:
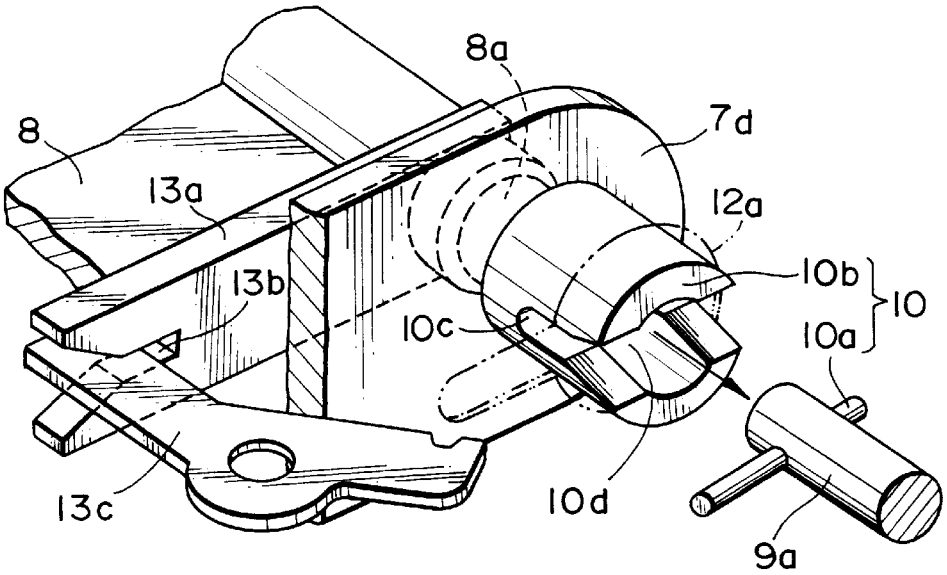
FIGS. 12 and 13 are respectively a perspective view and a side elevation showing a specific configuration of a coupling included in the embodiment.
Figure 13:
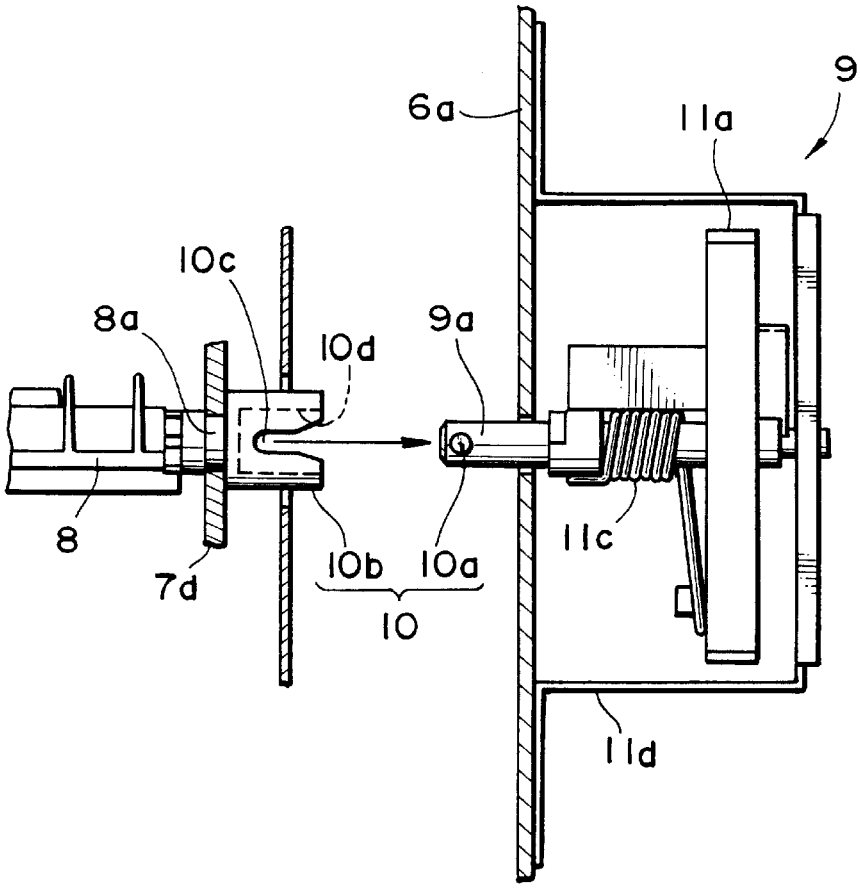

As shown in FIGS. 12 and 13 specifically, the coupling 10 has a coupling pin 10*a* and a cylindrical coupling body 10*b*. The coupling body 10*b* is formed with notches 10*c* for receiving the coupling pin 10*a*, and a coupling hole 10*d* for receiving the end portion of a shaft (drive shat 9*a* in the embodiment) on which the pin 10*a* is studded. In this configuration, the coupling pin 10*a* implements a projection extending substantially perpendicularly to the axis of the drive shaft 9*a* while the notches 10*c* implement a recess formed in the end of the shaft 8*a*.

In FIGS. 5 and 6, when the box 7 is moved to the right (direction in which the box 7 is to be mounted), the hole 10*d* of the coupling body 10*b* mates with the end of the drive shaft 9*a* while the notches 10*c* of the body 10*b* mate with the coupling pin 10*a*. In this condition, the rotation of the drive shaft 9*a* is transmitted to the shaft 8*a* of the plate 8. When the box 7 is moved to the left (direction in which the box 7 is to be dismounted), the notches 10*c* and hole 10*d* of the coupling body 10*b* are respectively released from the coupling pin 10*a* and the end of the drive shaft 9*a*. As a result, the shaft 8*a* is separated from the body of the collecting device 6 together with the box 7.

As shown in FIGS. 7A–7C, the rotatable angle of the compression plate 8 sequentially varies as the number of waste masters 8 compressed in the box 7 increases. It is therefore necessary to vary the amount of rotation of the plate 8 in accordance with the varying number of masters 3 collected in the box 7. To control the amount of rotation of the plate 8, a stepping motor may be included in the drive means 9 as a drive source and driven by the number of steps corresponding to the number of masters 3 collected in the box 7. However, simply controlling the rotation angle of the plate 8 on the basis of the number of masters 3 is undesirable because the number of masters 3 which can be accommodated in the box 7 depends on, e.g., the size of the masters 3 and how the masters 3 are folded. For example, if the masters 3 collected in the box 7 are of comparatively small size, the box 7 will be determined to be full despite that a space is still available in the box 7. Further, if the folded masters 3 are more bulky than expected, excessive loads will act on the plate 8 and drive source. In any case, a difference occurs between the allowable number of masters 3 to be accommodated in the box 7 and the capacity of the box 7.

Figure 17:
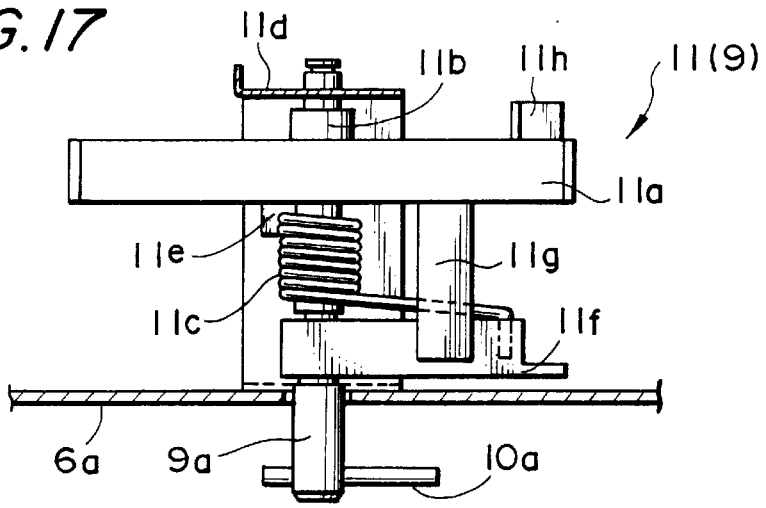
FIGS. 17 and 18 are respectively a plan view and a front view showing a torque limiter further included in the embodiment.
Figure 18:
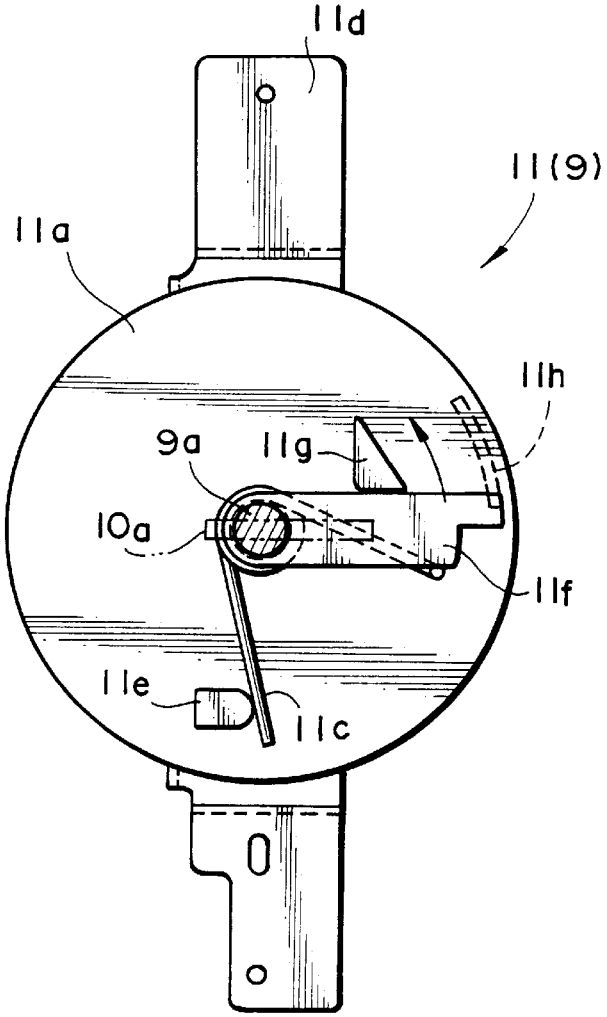

In light of the above, as shown in FIGS. 17–20, a torque limiter 11 intervenes between the drive shaft 9*a* of the drive means 9 and the drive source, not shown, of the drive means 9. In the illustrative embodiment, the torque limiter 11 includes a drive gear 11*a* which is rotated counterclockwise, as seen in FIG. 18, by the drive source of the drive means 9. The rotation of the drive gear 11*a* is transferred to the drive shaft 9*a* via a coil spring 11*c* wound round the shaft 11*b* of the drive gear 11*a*.

Specifically, as shown in FIGS. 17 and 18, the shaft 11*b* of the drive gear 11*a* is journalled to a bracket 11*d* (see also FIG. 13) affixed to the side panel 6*a* of the collecting device 6. The coil spring 11*c* wound round the shaft 11*b* is retained by a drive piece 11*e* at one end thereof. The drive piece 11*e* is formed integrally with one end of the drive gear 11*a*. The other end of the coil spring 11*c* is retained by a driven arm 11*f* formed integrally with the shaft 9*a* and rotatably mounted on the shaft 11*b*. In this configuration, the drive shaft 9*a* is constantly biased counterclockwise by the torsional resiliency of the coil spring 11*c* via the driven arm 11*f*. The rotation of the drive shaft 9*a* ascriable to such a bias is prevented by the driven arm 11*f* contacting a lock piece 11*g* formed integrally with the end of the drive gear 11*a*.

Figure 19:
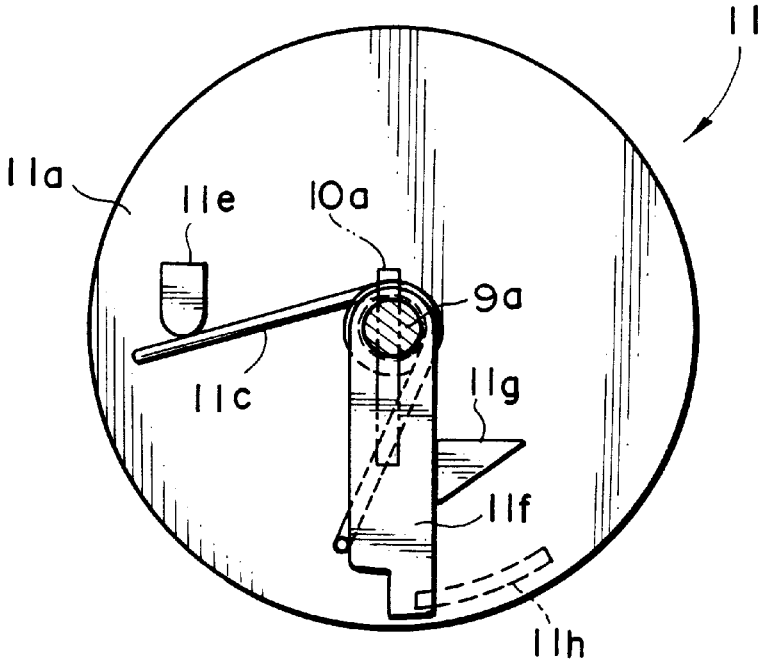
FIGS. 19 and 20 are front views demonstrating the operation of the torque limiter shown in FIGS. 17 and 18.

As shown in FIG. 19, assume that the drive gear 11*a* is rotated counterclockwise by about 270 degrees by the drive source of the drive means 9. Then, the drive piece 11*e* of the drive gear 11*a* forces the coil spring 11*c* in the counterclockwise direction. As a result, the driven arm 11*f* is rotated by the same angle as the drive gear 11*a* due to the resiliency of the other end of the coil spring 11*c*. It follows that the drive shaft 9*a* is driven counterclockwise via the driven arm 11*f*, causing the plate 8 to rotate about 270 degrees via the coupling 10, as shown in FIG. 7A.

Figure 20:
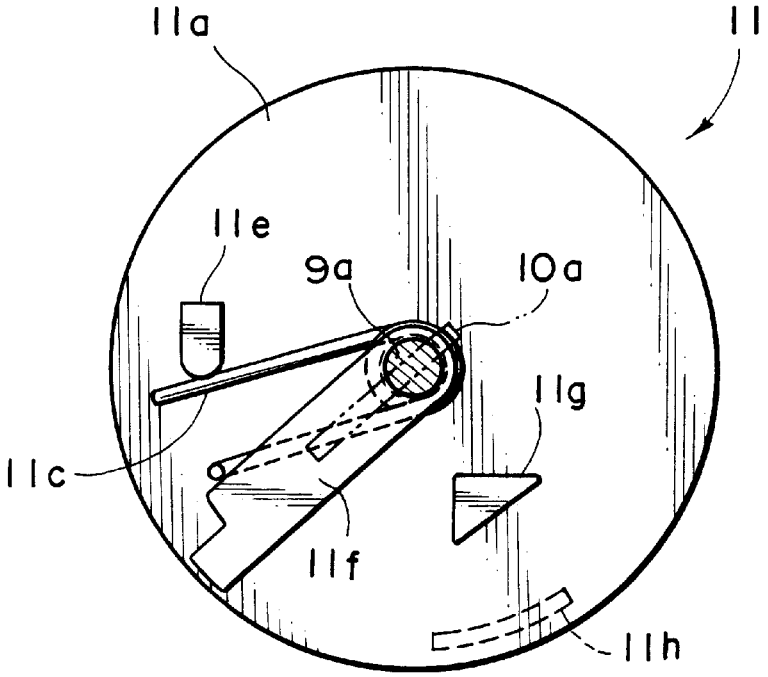

Assume that the folded masters 3 collected in the box 7 are more bulky than expected and allow the plate 8 to rotate only about 200 degrees by way of example. Then, as shown in FIG. 20, the driven arm 11*f* stops rotating at an angular position of about 200 degrees. Even in this condition, the drive piece 11*e* tightens the coil spring 11*c* against the resiliency of the spring 11*c*, so that the driven gear 11*a* can rotate to the preselected angular position (about 270 degrees).

As stated above, whatever the angular position where the plate 8, i.e., driven arm 11*f* stops rotating due to the masters 3 collected in the box 7 may be, the torque limiter 11 allows the drive gear 11*a* to complete the expected rotation. Therefore, by transmitting the rotation of the drive source to the drive shaft 9*a* via the torque limiter 11, it is possible to pack the box 7 with the masters 3 up to its limit without resorting to strict control over the amount of rotation of the plate 8, i.e., gear 11*a* and without regard to the size, number or folded condition of the masters 3. This facilitates the control over the amount of rotation of the plate 8. In the illustrative embodiment, when the box 7 reaches the limit of its capacity, i.e., when the driven arm 11*f* cannot rotate more than about 90 degrees, as shown in FIG. 7C, the box 7 is determined to be full. A sensor, not shown, senses such a limit position of the driven arm 11*f* and causes the full state of the box 7 to be displayed.

In the illustrative embodiment, the rotation of the drive shaft 9*a* is transmitted to the shaft 8*a* of the plate 8 via the coupling 10, as stated earlier. A prerequisite with this configuration is that the two parts of the coupling 10 respectively provided on the shaft 8*a* and drive shaft 9*a* be accurately matched in relative angular position at the time of mounting of the box 7 to the body of the collecting device 6; otherwise, it is likely that the mounting of the box 7 is defective, and the shaft 8*a* is coupled to the drive shaft 9*a* in a phase 180 degrees deviated from the expected phase. Moreover, the operator is likely to pull out the box 7 while the plate 8 is in operation. It is therefore preferable that the coupling 10 be coupled with the shaft 8*a* being held in its home position matching with the home position of the drive shaft 9*a*, and that the box 7 be prevented from being pulled out while the plate 8 is in operation.

Figure 21:
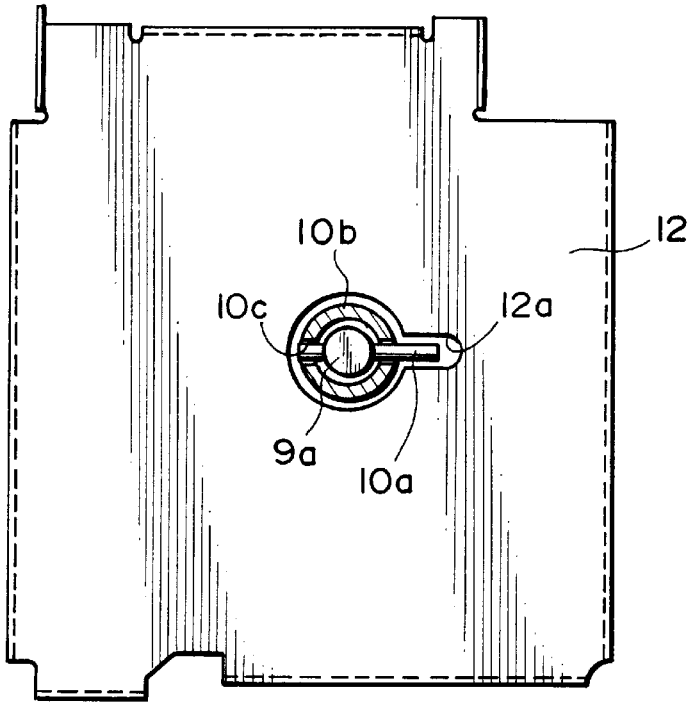
FIG. 21 is a fragmentary front view showing a positional relation between a hole formed in a cover included in the box and the coupling pin at a home position.
Figure 22:
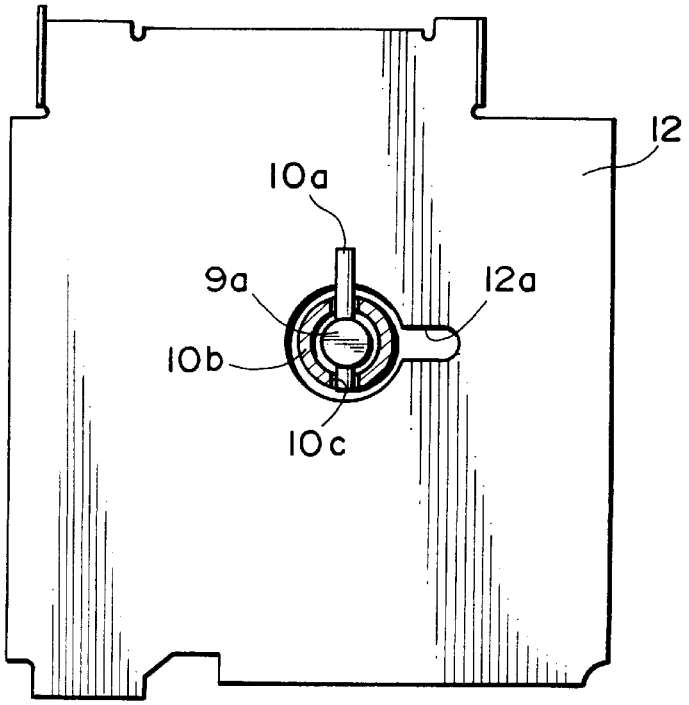
FIG. 22 is a view similar to FIG. 2, showing a positional relation at a position other than the home position.

FIGS. 21 and 22 show a specific implementation for satisfying the above conditions. As shown, a cover 12 is formed with a hole 12*a* resembling a keyhole. As shown in FIGS. 5 and 6, the cover 12 is rotatably mounted on the box 7 via a shaft 12*e* such that it opens and closes a master outlet 7*e* (right open end of the box 7). As shown in FIG. 21, when the drive shaft 9*a* of the drive means 9 is in its home position, the hole 12*a* is ready to receive or release the coupling pin 10*a* substantially perpendicular to the axis of the drive shaft 9*a*. Also, as shown in FIG. 22, when the box 7 is mounted to the body of the collecting device 6 and if the drive shaft 9*a* is not in its home position, the coupling pin 10*a* abuts against the edge portion of the hole 12*a*. As shown in FIGS. 17 and 18, a light interscepting plate 11*h* is formed integrally with one end of the drive gear 11*a*. A sensor, not shown, senses the home position of the drive shaft 9*a* in cooperation with the light intercepting piece 11*h*.

As shown in FIG. 21, the coupling 10 can be engaged or disengaged only when the shaft 8*a* of the plate 8 is held in its home position while the drive shaft 9*a* of the drive means 9 is also held in its home position. As shown in FIG. 22, while the plate 8 is in operation, the coupling pin 10*a* abuts against the edge portion of the hole 12*a* and prevents the box 7 from being pulled out of the body of the collecting device 6.

Figure 14:
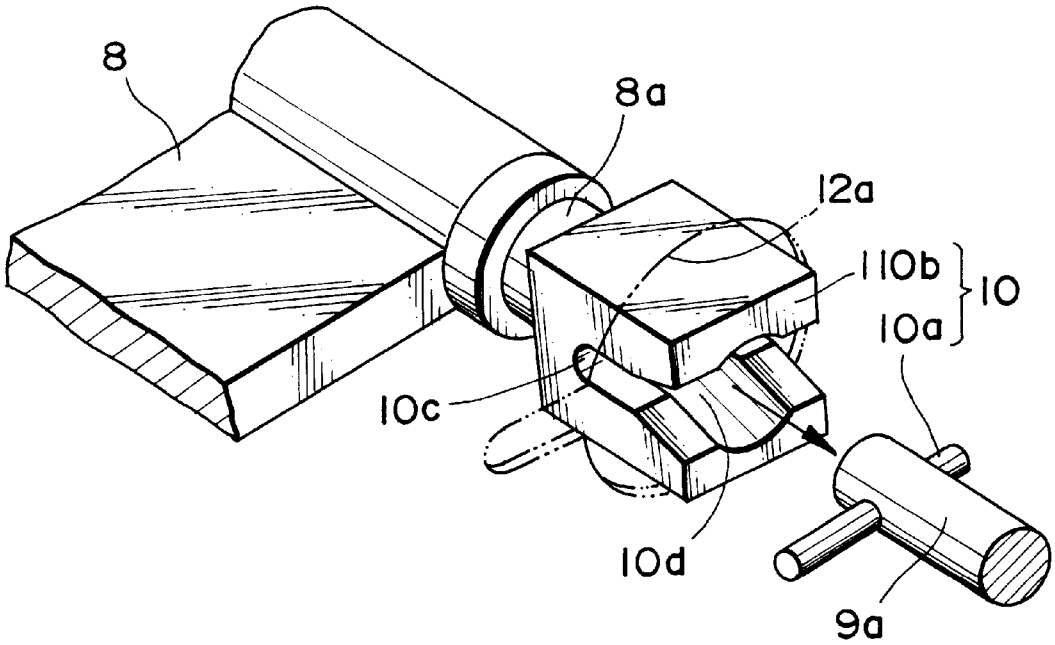
FIG. 14 is a perspective view showing another specific configuration of a coupling body included in the coupling of FIGS. 12 and 13.
Figure 15:
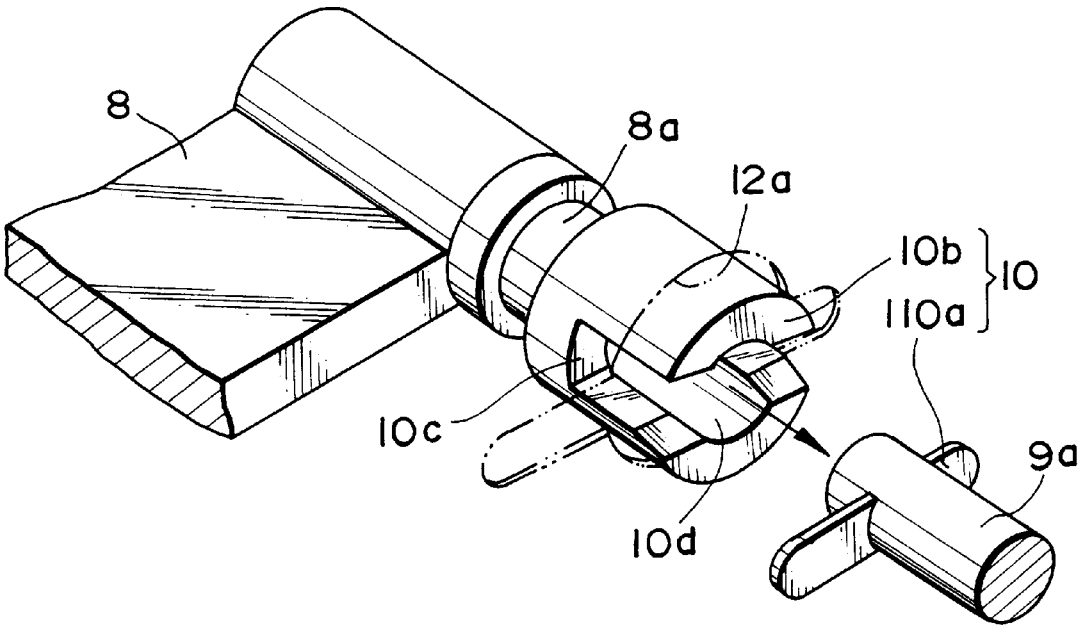
FIG. 15 is a perspective view showing another specific configuration of a coupling pin also included in the coupling of FIGS. 12 and 13.

As shown in FIG. 14, the coupling body 10*b* may be replaced with a coupling body 110*b* having a generally rectangular configuration. Also, as shown in FIG. 15, the coupling pin 10*a* may be replaced with a flat pin 110*a* asymmetrical with respect to the drive shaft 9*a*. The crux is that the coupling body and coupling pin match the relative angular position of the two parts of the coupling 10. Further, the hole 12*a* may be so configured as to receive the asymmetrical flat pin 110*a* or a disk-like coupling pin having a projection. The crux is that the hole 12*a* allows the box 7 to be pulled out only when the coupling pin or projection of the coupling 10 is held in the preselected angular position.

Another specific configuration of the coupling 10 will be described hereinafter. In the above coupling 10, the coupling pin 10*a* is received in the hole 12*a* while being received in the notches 10*c*. This implements a mechanism for connecting and disconnecting the drive shaft 9*a* and shaft 8*a*, and a mechanism for setting up drive transmission to the box 7 while preventing the box 7 from being pulled out. In the configuration to be described hereinafter, the two mechanisms are implemented by an Oldham coupling.

Figure 16:
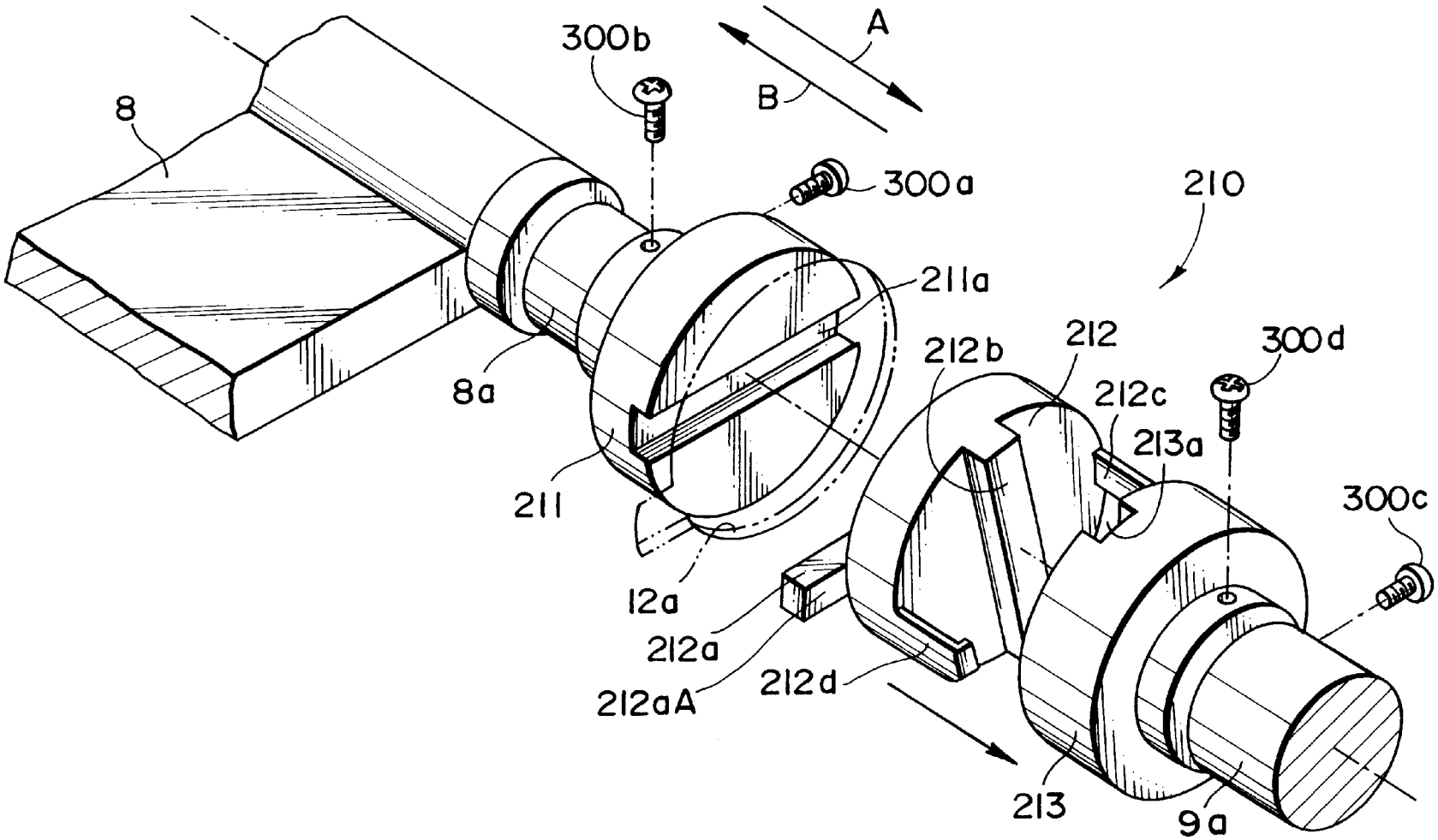
FIG. 16 is a perspective view showing another specific configuration of the coupling.

Specifically, as shown in FIG. 16, an Oldham coupling 210 is made up of a driven coupling member 211, a slider 212, and a drive coupling member 213. The driven coupling member 211 is removably fastened to the shaft 8*a* of the plate 8 by screws 300*a* and 300*b*. A recess 211*a* is formed in the outer surface of the driven coupling member 211 in order to receive a rectangular projection 212*a* formed on the slider 212. The drive coupling member 213 is removably fastened to the drive shaft 9*a* by screws 300*c* and 300*d*. A recess 213*a* is formed in the outer surface of the drive coupling member 213 in order to receive a rectangular projection 212*b* also formed on the slider 212. The projections 212*a* and 212*b* formed on opposite surfaces of the slider 212 are perpendicular to each other. One end of the projection 212*a* perpendicular to the axis of the slider 212 protrudes from the circumference of the slider 212, forming a lock portion 212*a*A. Hook members 212*c* and 212*d* are provided on the surface of the slider 212 facing the drive coupling member 213. The hook members 212*c* and 212*d* engage with the outer circumferential edge of the drive connecting member 212. In this condition, the slider 212 and drive coupling member 213 are freely movable relative to each other in the direction perpendicular to their aligned axes with the projection 212*b* mating with the recess 213*a*.

Assume that the shaft 8*a* of the plate 8 is moved in a direction indicated by an arrow A in FIG. 16, i.e., in the mounting direction. Then, the recess 211*a* of the driven coupling member 211 mates with the projection 212*a* of the slider 212, operatively connecting the shaft 8*a* to the drive shaft 9*a*. In this condition, the rotation of the drive shaft 9*a* is transmitted to the shaft 8*a*. On the other hand, when the shaft 8*a* is moved in a direction indicated by an arrow B, i.e., in the dismounting direction, the recess 211*a* is released from the projection 212*a*, disconnecting the shaft 8*a* from the drive shaft 9*a*. As a result, the shaft 8*a* is separated from the body of the collecting device 6 together with the box 7. At this instant, the lock portion 212A of the projection 212*a* is passed through the hole 12*a*.

When the plate 8 is in its home position, the lock portion 212*a*A of the projection 212*a* is capable of passing through the hole 12*a* and allows the shaft 8*a* to be moved into and out of the body of the collecting device 6 together with the box 7. When the plate 8 is not in its home position, the lock portion 212*a*A abuts against the edge portion of the hole 12*a* and prevents the box 7 from being pulled out of the body of the collecting device 6.

When the shaft 8*a* and drive shaft 9*a* are connected by the Oldham coupling 210, it is not necessary to machine the shaft 8*a* and drive shaft 9*a* such that their axes precisely align with each other. In this case, the projection 212*a* of the slider 212 implement the projection substantially perpendicular to the drive shaft 9*a* while the recess 211*a* of the driven coupling member 211 implements the recess formed in the end of the shaft 8*a*. To discard the masters 3 collected in the box 7, the operator slides a push plate, not shown, disposed in the box 7 in the vicinity of the front wall 7*c* (see FIG. 5) toward the master outlet 7*e* from the outside of the box 7. As a result, the cover 12 of the box 7 is opened. A specific device for so operating the push plate is disclosed in Japanese Patent Application No. 8-158415 mentioned earlier.

In the above drive transmission from the drive shaft 9*a* to the shaft 8*a* via the coupling 10, when the box 7 is pulled out of the body of the collecting device 6, the plate 8 is freely rotatable. This also brings about the problem that if the two parts of the coupling 10 provided on the shafts 8*a* and drive shaft 9, respectively, are not matched in relative angular position at the time of mounting of the box 7, the box 7 is difficult to mount to the body of the collecting device 6. It is therefore preferable that the shaft 8*a* be constantly locked in its home position engageable with the drive shaft 9*a* while the box 7 is positioned outside of the body of the collecting device 6.

Figure 23:
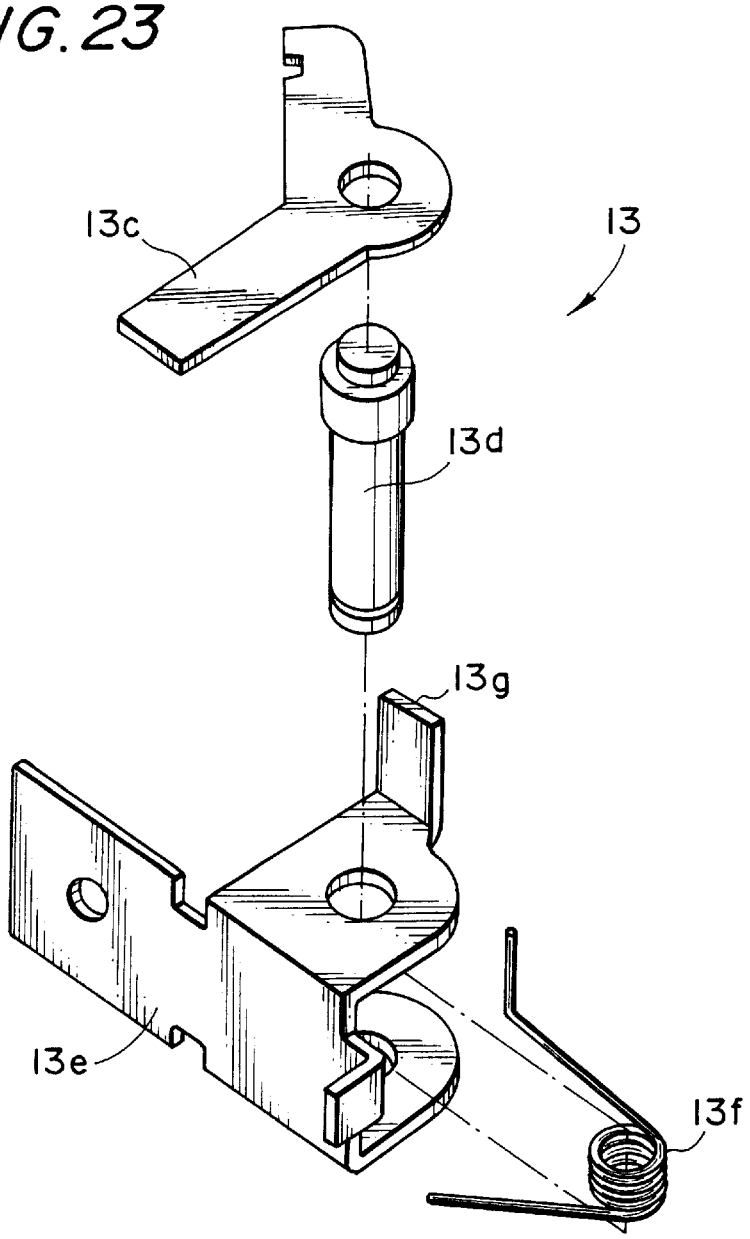
FIGS. 23 and 24 are respectively an exploded perspective view and a front view showing a stop additionally included in the embodiment.
Figure 24:
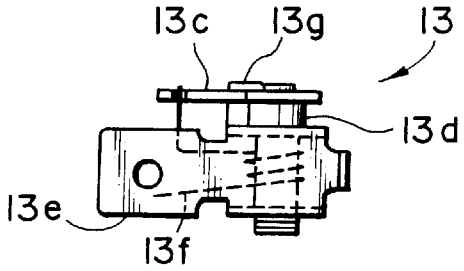

In light of the above, the embodiment additionally includes a stop 13 mounted on the box 7. The stop 13 prevents the plate 8 from rotating when the plate 8 is in its home position and when the box 7 is dismounted from the body of the collecting device 6. The stop 13 allows the plate 8 to freely rotate when the box 7 is mounted to the body of the collecting device 6. Specifically, as shown in FIGS. 23 and 24, the stop 13 is made up of a stop arm 13*c*, a stop shaft 13*d* studded on the arm 13*c*, a stop bracket 13*e* rotatably supporting the shaft 13*d*, and a stop spring 13*f*. The stop arm 13*c* is movable into and out of a notch 13*b* formed in a lock member 13*a* (see FIG. 12) which is formed integrally with the rear end of the plate 8. The stop spring 13*f* constantly biases the stop arm 13*c* toward the notch 13*b*. The rotation of the stop arm 13*c* toward the notch 13*b* due to the above bias is prevented because the arm 13*c* abuts against a lock piece 13*g* formed on the stop bracket 13*e*.

Figure 25:
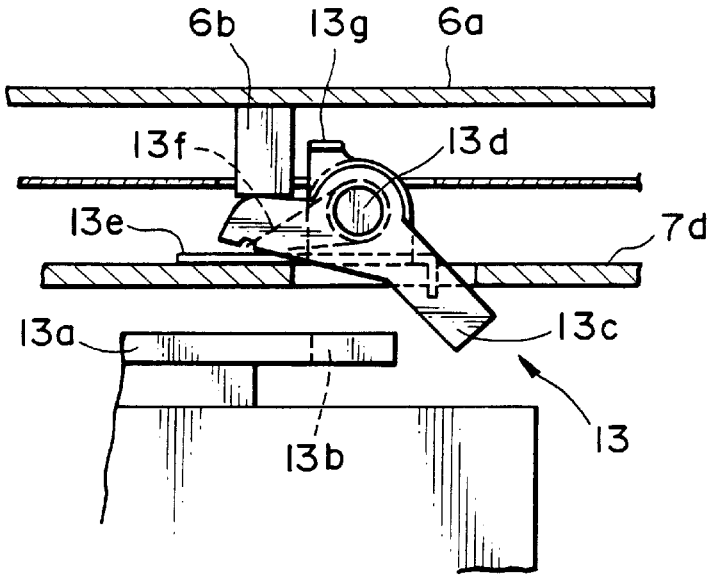
FIGS. 25 and 26 are plan views respectively showing the stop in a condition wherein the box is mounted and in a condition wherein the box is dismounted.
Figure 26:
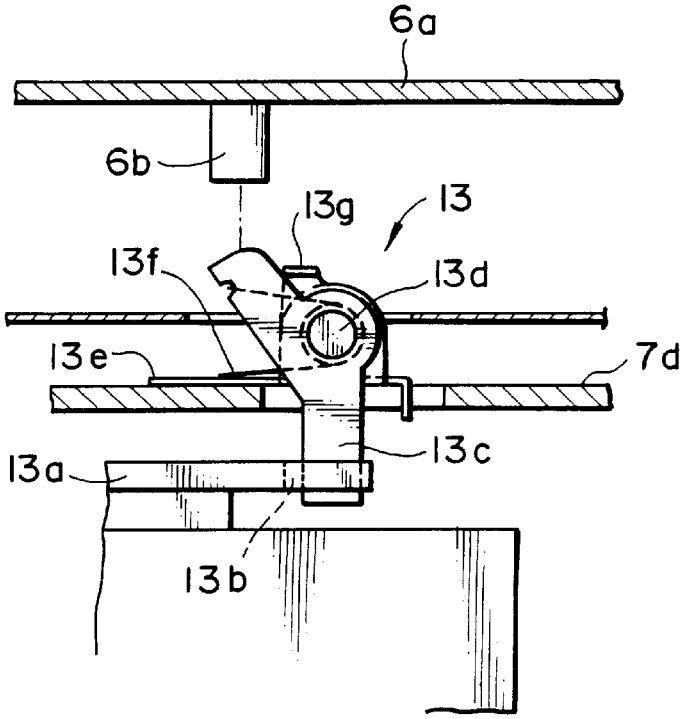

As shown in FIGS. 25 and 26, the stop bracket 13*e* is affixed to the bracket 7*d* of the box 7. As shown in FIG. 25, when the box 7 is mounted to the body of the collecting device 6, a lug 6*b* provided on the side wall 6*a* causes the stop arm 13*c* to rotate counterclockwise against the force of the stop spring 13*f*. As a result, the stop arm 13*c* is released from the notch 13*b* of the lock member 13*a*. As shown in FIG. 26, when the box 7 is pulled out of the body of the collecting device 6 with the shaft 8*a* of the plate 8 remaining in its home position engageable with the drive shaft 9*a*, the stop arm 13*c* is released from the lug 6*b* and caused to rotate clockwise due to the bias of the stop spring 13*f*. As a result, the stop arm 13*c* is received in the notch 13*b* of the lock members 13*a*.

As stated above, while the box 7 is located outside of the body of the collecting device 6, the stop 13 constantly locks the shaft 8*a* of the plate 8 in its home position engageable with the drive shaft 9*a*. Consequently, whenever the box 7 is mountd to the body of the collecting device 6, the two parts of the coupling 10 provided on the shaft 8*a* and drive shaft 9*a*, respectively, are accurately matched in relative angular position. This promotes easy mounting of the box 7 to the body of the collecting device 6.

Figure 27:
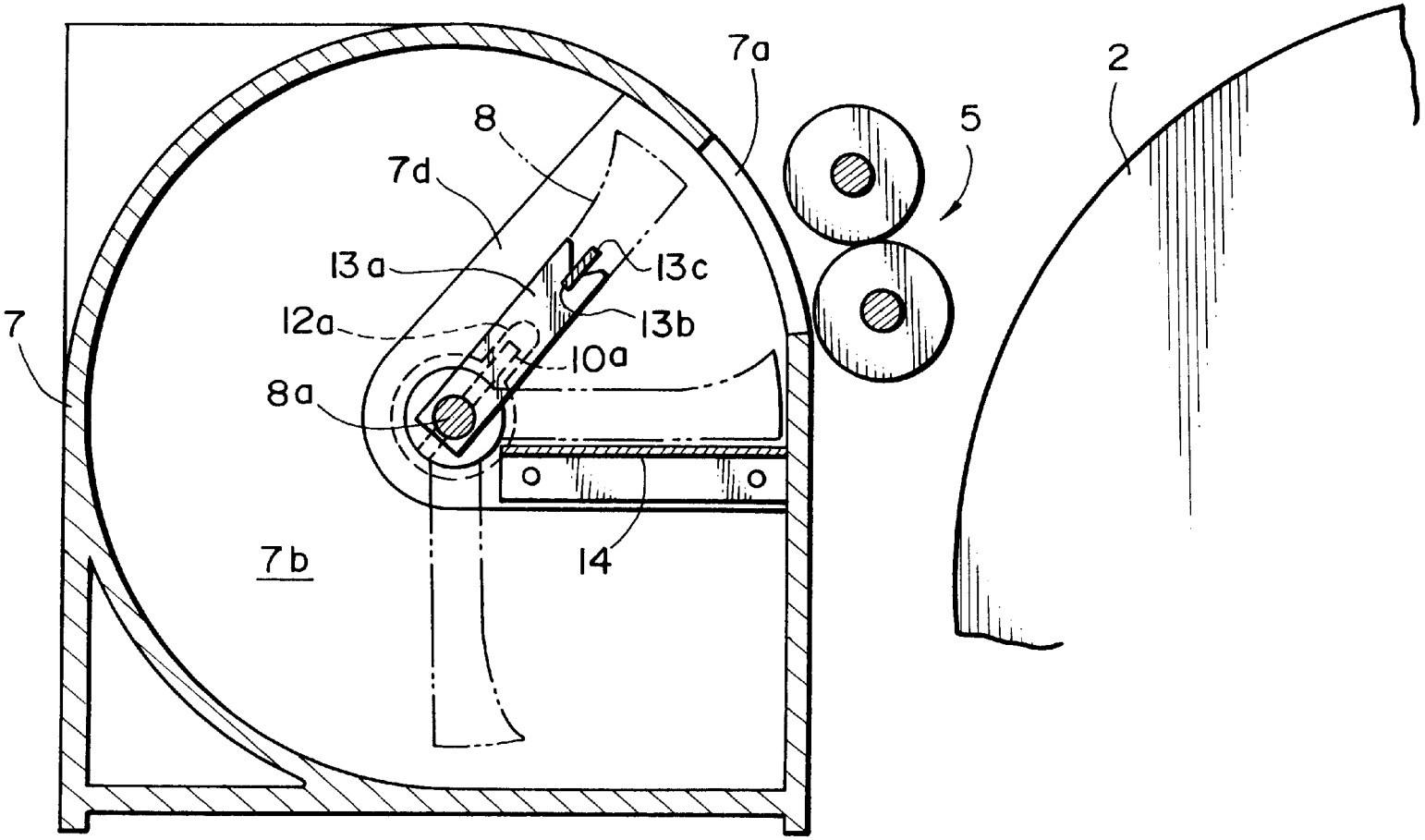
FIG. 27 is a sectional front view showing an alternative embodiment of the present invention.

FIG. 27 shows another specific home position of the plate 8 representative of an alternative embodiment of the present invention. As shown, at the home position, the plate 8 blocks the inlet of the master storing space 7*b* of the box 7. In this case, the stop 13 may be configured such that the stop arm 13*c* prevents the plate 8 from rotating at such an alternative home position. Of course, the positional relation between the hole 12*a* of the cover 12 and the projection of the coupling 10, e.g., the coupling pin 10*a* will be determined on the basis of the home position shown in FIG. 27. With this configuration, it is possible to prevent the masters 3 collected in the box 7 from showing themselves via the inlet 7*a* when the box 7 is pulled out of the body of the collecting device 6; otherwise, the masters 3 are apt to overflow via the inlet 7*a* or smear the operator's hands and cloths. Further, the home position of the plate 8 may be one to which the plate 8 is returned by a preselected amount when the sensor, not shown, of the box 7 senses the full state of the box 7.

Figure 28:
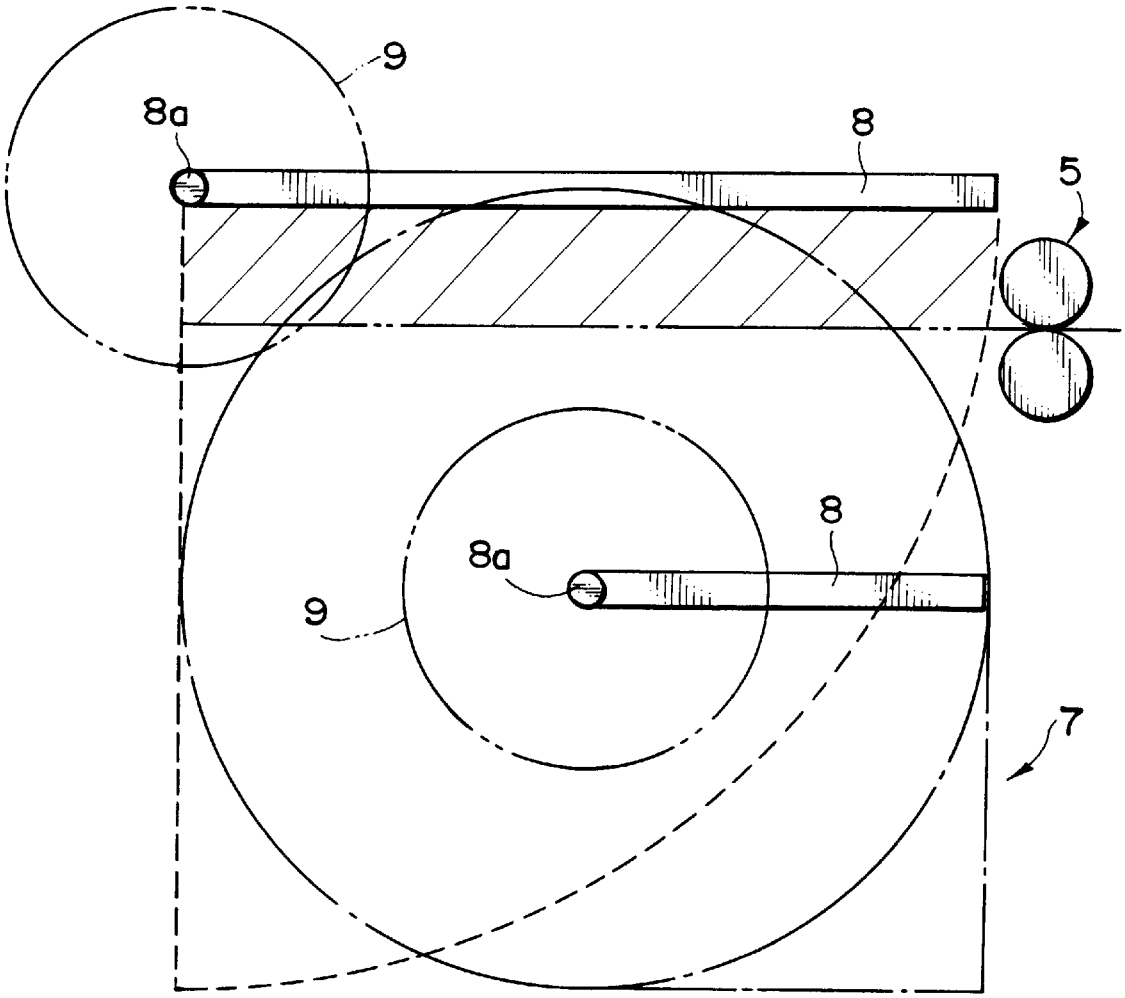
FIG. 28 is a diagram showing a difference between the present invention and the prior art.

As shown in FIG. 28, the master storing space available with the box 7 of the illustrative embodiment (dash-and dot line) is greater in sectional area than the space available with the conventional collecting device (dash-and-dots line). This successfully increases the number of waste masters 3 that can be accommodated in the box 7. Even if the conventional device is free from the dead space B shown in FIG. 2, it still needs a space (indicated by hatching in FIG. 28) for retracting the plate 8. This space reduces the capacity of the device.

Furthermore, for a given storing capacity, the size of the plate 8 of the embodiment can be reduced to less than one half of the conventional plate 8. Such a small plate 8 can be driven by a smaller torque than the conventional plate 8, promoting the miniaturization of the drive means 9. Moreover, assuming that the plate 8 of the embodiment is driven by the same drive means 9 as the conventional plate 8, the former can be driven by a greater torque than the conventional plate 8. This increases the compressing force of the plate 8 to act on the collected masters 3 and thereby increases the number of masters 3 that can be accommodated in the box.

In addition, the illustrative embodiment has the drive means 9 arranged at one side of the box 7. Therefore, the body of the collecting device 6 is smaller in size than the conventional one in which the drive means protrudes from the top.

In summary, it will be seen that the present invention provides a waste master collecting device for a stencil printer and having various unprecedented advantages, as enumerated below.

(1) The collecting device can be arranged in the body of a printer without resorting to an exclusive space.

(2) A waste master box can be designed with enhanced freedom.

(3) Waster masters collected in the box and compressed by a compression plate are prevented from easily returning to an inlet formed in the box.

(4) The localization of the masters in the box which would result in a dead space is obviated, so that the box can be packed with the masters to its full capacity.

(5) The collecting device is miniature.

(6) Each waste master introduced into the box is neatly folded on the plate, raised, rotated and then compressed. Such a procedure is repeated to neatly compress the consecutive masters sequentially entering the box.

(7) Structural elements other than the box occupy a minimum of space in the body of the collecting device.

(8) When the box is pulled out of the body of the printer, the masters in the box are prevented from showing themselves via the inlet. The masters are therefore prevented from overflowing the box via the inelt or smearing the operator's hands and cloths.

(9) The compression plate is prevented from rotating excessively toward its home position. In addition, the home position to which the plate is to be retracted for avoiding, interfering with the incoming waste master is guaranteed.

(10) The master introduced into the box is surely conveyed and compressed. This, coupled with the fact that such masters are neatly compressed, starting at a deepest box-like portion included in the box, increases the capacity of the box.

(11) The box can accommodate the masters to its full capacity without resorting to strict control over the amount of rotation of the plate and without regard to the size and number of waste masters or the folded condition of each waste master. This facilitates the control over the amount of rotation of the plate.

(12) Only when the shaft of the plate is held in its home position while the drive shaft of drive means in its home position, a coupling can be engaged or disengaged. In addition, while the plate is in operation, a projection abuts agaist the edge portion of a hole. It is therefore possible to match the angular position of the shaft of the plate and that of the drive shaft of the drive means at the time of coupling, and to prevent the box from being pulled out by accident while the plate is in operation.

(13) When the box is pulled out of the body of the collecting device, the compression plate is prevented from rotataing. Therefore, the shaft of the plate and the drive shaft of the drive means are surely matched in angular position with each other. This allows the box to be inserted into the body of the collecting device with ease.

(14) Because the masters collected in the box are prevented from showing themselves, as stated previously, and because the box can be pulled out while being packed with the masters, the masters are prevented from overflowing the box or smearing the operator's hands and cloths when the box is pulled out.

Various modifications will become possible for those skilled in the art after receiving the teachings of the present disclosure without departing from the scope thereof.

What is claimed is:

1. A waste master collecting device for a printer, comprising:

waste master discharging means for peeling off a waste master wrapped around a print drum of the printer, and conveying the waste master; and a waste master box including a waste master inlet, said waste master box configured to accommodate the waste master conveyed by said waste master discharging means;

said waste master box comprising a compression plate for compressing the waste master introduced into said waste master box by said waste master discharging means, and a shaft provided within said waste master box for supporting one edge of said compression plate such that said compression plate extends substantially perpendicularly to a waste master path, and causing said compression plate to rotate about said shaft in said waste master box, said waste master box including an inner circumferential surface having a substantially cylindrical configuration complementary to a locus of rotation of said compression plate;

said compression plate being rotatable at least more than 90 degrees about said shaft for compressing the waste master introduced into said waste master box, and away from said waste master inlet;

said compression plate having a home position wherein the waste master inlet of said waste master box is blocked by said compression plate when said compression plate is held in the home position.

2. A device as claimed in claim 1, wherein said shaft of said compression plate is positioned at a center of said waste master box.

3. A device as claimed in claim 2, wherein said waste master discharging means conveys the waste master to a position above said compression plate.

4. A device as claimed in claim 3, further comprising drive means including a drive shaft for causing said shaft of said compression plate to rotate, and a coupling for selectively connecting said drive shaft and said shaft, wherein said waste master box is removably mounted to a body of said device.

5. A device as claimed in claim 4, further comprising a partition mounted to an interior of said waste master box for separating and storing compressed waste masters separate from a waste master introduced into said waste master box by said waste master discharging means.

6. A device as claimed in claim 5, wherein said waste master box has an inner circumferential surface having a substantially cylindrical configuration complementary to a locus of rotation of said compression plate up to at least 270 degrees, but having a substantially box-like configuration in an angular range exceeding 270 degrees.

7. A device as claimed in claim 6, further comprising a torque limiter for transmitting a rotation of a drive source of said drive means to said drive shaft of said drive means.

8. A device as claimed in claim 1, wherein said waste master discharging means conveys the waste master to a position above said compression plate.

9. A device as claimed in claim 8, further comprising drive means including a drive shaft for causing said shaft of said compression plate to rotate, and a coupling for selectively connecting said drive shaft and said shaft, wherein said waste master box is removably mounted to a body of said device.

10. A device as claimed in claim 9, further comprising a partition mounted to an interior of said waste master box for separating and storing compressed waste masters separate from a waste master introduced into said waste master box by said waste master discharging means.

11. A device as claimed in claim 10, wherein said waste master box has an inner circumferential surface having a substantially cylindrical configuration complementary to a locus of rotation of said compression plate up to at least 270 degrees, but having a substantially box-like configuration in an angular range exceeding 270 degrees.

12. A device as claimed in claim 11, further comprising a torque limiter for transmitting a rotation of a drive source of said drive means to said drive shaft of said drive means.

13. A device as claimed in claim 1, further comprising drive means including a drive shaft for causing said shaft of said compression plate to rotate, and a coupling for selectively connecting said drive shaft and said shaft, wherein said waste master box is removably mounted to a body of said device.

14. A device as claimed in claim 13, further comprising a partition mounted to an interior of said waste master box for separating and storing compressed waste masters separate from a waste master introduced into said waste master box by said waste master discharging means.

15. A device as claimed in claim 14, wherein said waste master box has an inner circumferential surface having a substantially cylindrical configuration complementary to a locus of rotation of said compression plate up to at least 270 degrees, but having a substantially box-like configuration in an angular range exceeding 270 degrees.

16. A device as claimed in claim 15, further comprising a torque limiter for transmitting a rotation of a drive source of said drive means to said drive shaft of said drive means.

17. A device as claimed in claim 13, wherein said waste master box has an inner circumferential surface having a substantially cylindrical configuration complementary to a locus of rotation of said compression plate up to at least 270 degrees, but having a substantially box-like configuration in an angular range exceeding 270 degrees.

18. A device as claimed in claim 17, further comprising a torque limiter for transmitting a rotation of a drive source of said drive means to said drive shaft of said drive means.

19. A waste master collecting device for a printer, comprising:

waste master discharging means for peeling off a waste master wrapped around a print drum of the printer, and conveying the waste master; and a waste master box for accommodating the waste master conveyed by said waste master discharging means;

said waste master box comprising a compression plate for compressing the waste master introduced into said waste master box by said waste master discharging means, and a shaft supporting one edge of said compression plate such that said compression plate extends substantially perpendicularly to a waste master discharge path, and causing said compression plate to rotate about said shaft in said waste master box;

said compression plate is rotatable at least more than 90 degrees about said shaft for compressing the waste master introduced into said waste master box;

drive means including a drive shaft for causing said shaft of said compression plate to rotate, and a coupling for selectively connecting said drive shaft and said shaft, wherein said waste master box is removably mounted to a body of said device;

wherein said coup ling comprises:

a projection formed on said drive shaft of said drive means substantially perpendicularly to an axis of said drive shaft; and a recess formed in an end of said shaft of said compression plate;

said waste master box or a member substantially integral with said waste master box being formed with an aperture;

wherein said aperture is freely engageable and disengageable from said projection when said drive shaft of said drive means is in a home position as to angular position, or is engaged with said projection when said waste master box is mounted to said body of said device and if said drive shaft is in an angular position other than said home position.

20. A device as claimed in claim 19, wherein said waste master box further comprises a stop for preventing said compression plate from rotating when said waste master box is dismounted from said body of said device with said compression plate assuming a home position thereof, or allowing said compression plate to freely rotate when said waste master box is mounted to said body.

21. A device as claimed in claim 20, wherein said compression plate blocks an inlet of a master storing space of said waste master box when held in said home position.

22. A device as claimed in claim 1, further comprising a partition mounted to an interior of said waste master box for separating and storing compressed waste masters separate from a waste master introduced into said waste master box by said waste master discharging means.

23. A device as claimed in claim 22, wherein said waste master box has an inner circumferential surface having a substantially cylindrical configuration complementary to a locus of rotation of said compression plate up to at least 270 degrees, but having a substantially box-like configuration in an angular range exceeding 270 degrees.

24. A device as claimed in claim 1, wherein said waste master box has an inner circumferential surface having a substantially cylindrical configuration complementary to a locus of rotation of said compression plate up to at least 270 degrees, but having a substantially box-like configuration in an angular range exceeding 270 degrees.

25. A waste master collecting device for a printer, comprising:

waste master discharging means for peeling off a waste master wrapped around a print drum of the printer, and conveying the waste master; and a waste master box including a waste master inlet, said waste master box configured to accommodate the waste master conveyed by said waster master discharging means;

said waste master box comprising a compression plate for compressing the waste master introduced into said waste master box by said waste master discharging means, and a shaft provided at a center of said waste master box for supporting one edge of said compression plate such that said compression plate extends substantially perpendicularly to a waste master discharge path, and causing said compression plate to rotate about said shaft in said waste master box, said waste master box including an inner circumferential surface having a substantially cylindrical configuration complementary to a locus of rotation of said compression plate;

said waste master discharging means conveying the waste master to a position above said compression plate;

said compression plate being rotatable at least more than 90 degrees about said shaft for compressing the waste master introduced into said waste master box, and away from said waste master inlet;

said waste master collecting device further comprising:

drive means including a drive shaft for causing said shaft of said compression plate to rotate, and a coupling for selectively connecting said drive shaft and said shaft, wherein said waste master box is removably mounted to a body of said device; and a partition for separating, when another waste master is introduced into said waste master box by said waste master discharging means, said another waste master from the waste master compressed and stored in said waste master box.

26. A device as claimed in claim 25, wherein said waste master box has an inner circumferential surface having a substantially cylindrical configuration complementary to a locus of rotation of said compression plate up to at least 270 degrees, but having a substantially box-like configuration in an angular range exceeding 270 degrees.

27. A device as claimed in claim 26, further comprising a torque limiter for transmitting a rotation of a drive source of said drive means to said drive shaft of said drive means.

* * * * *

UNITED STATES PATENT AND TRADEMARK OFFICE

CERTIFICATE OF CORRECTION

PATENT NO. : 6,067,901

DATED : May 30, 2000

INVENTOR(S): TAKAYUKI TAKAHASHI

It is certified that an error appears in the above-identified patent and that said Letters Patent is hereby corrected as shown below:

Column 3, line 52, delete "operaton" and insert --operation--;

Column 3, line 66, delete "replace" and insert --replaced--;

Column 4, line 23, delete "overlowing" and insert --overflowing--;

Column 4, line 25, delete "clockwidre" and insert --clockwise--;

Column 5, line 37, delete "complentary" and insert --complementary--;

Column 5, line 65, delete "shat" and insert --shaft--;

Column 10, line 2, delete "mountd" and insert --mounted--;

Column 11, line 32, delete "agaist" and insert --against--;

Column 13, line 43, delete "coup ling" and insert --coupling--;

Column 13, line 52, after "wherein" insert --an edge of--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*